US005470697A

United States Patent [19]

Kita et al.

[11] Patent Number: 5,470,697

[45] Date of Patent: Nov. 28, 1995

[54] SILVER HALIDE COLOR PHOTOGRAPHIC LIGHT SENSITIVE MATERIAL

[75] Inventors: Hiroshi Kita; Hiroshi Ishidai; Yutaka Kaneko, all of Hino, Japan

[73] Assignee: Konica Corporation, Japan

[21] Appl. No.: 252,268

[22] Filed: Jun. 1, 1994

[30] Foreign Application Priority Data

Jun. 3, 1993 [JP] Japan ..... 5-156373

[51] Int. Cl.[6] ..... G03C 7/38

[52] U.S. Cl. ..... 430/558; 430/387

[58] Field of Search ..... 430/558, 387

[56] References Cited

U.S. PATENT DOCUMENTS 4,992,361 2/1991 Bowne et al. ..... 430/558
5,336,593 8/1994 Daifuku et al. ..... 430/558

FOREIGN PATENT DOCUMENTS 849065 9/1960 United Kingdom ..... 430/558

OTHER PUBLICATIONS

Database WP1, Week 8810, AN-88-068575 JPA-63-024, 256; Feb. 1, 1988.

*Primary Examiner*—Lee C. Wright

*Attorney, Agent, or Firm*—Jordan B. Bierman; Bierman and Muserlian

[57] ABSTRACT

A magenta coupler and a light sensitive silver halide color photographic material containing the coupler are disclosed. The magenta coupler is represented by formulas

I

II wherein $R_1$ is a hydrogen atom or a substituent, $R_2$, $R_3$ and $R_4$ each represents a hydrogen atom or a substituent, L is an alkylene group, n is 0 or 1, $R_5$ and $R_6$ each represents a hydrogen atom or a substituent, where $R_5$ and $R_6$ may be condensed to form a cycle, and X is a hydrogen atom or an atom or a group that can be released upon the reaction with an oxidation product of color developing agent.

1 Claim, No Drawings

SILVER HALIDE COLOR PHOTOGRAPHIC LIGHT SENSITIVE MATERIAL

FIELD OF THE INVENTION

This invention relates to a silver halide color photographic light sensitive material containing a magenta coupler and, particularly, to a silver halide color photographic light sensitive material in which a color reproducibility and color reproducibility can be excellent and a dye image stable against heat and light can be obtained when containing a novel pyrazoloazole type magenta coupler therein.

BACKGROUND OF THE INVENTION

As for the couplers generally applicable to silver halide color photographic light sensitive materials, there have been known couplers including, for example, the yellow couplers each comprising a open-chained ketomethylene type compound, the magenta couplers each comprising a pyrazolone or pyrazoloazole type compound and the cyan couplers each comprising a phenol or naphthol type compound. Among them, a 5-pyrazolone compound has very often been used for the magenta couplers so far.

The known pyrazolone magenta couplers are described in, for example, U.S. Pat. Nos. 2,600,788 and 3,519,429 and Japanese Patent Publication Open to Public Inspection (hereinafter referred to as JP OPI Publication) Nos. 49-111631 (1974) and 57-35858 (1982). However, the dyes made of the pyrazolone magenta couplers have produced an undesirable side-absorption which has been demanded for the improvements, as described in 'The Theory of the Photographic Process', the 4th Ed., Macmillan Publishing Co., 1977, pp.356–358; 'Fine Chemical', Vol.14, No.8, CMC Press, pp.38–41; and the Lecture Transcription published at the 1985 Annual convention of the Society of Photographic Science of Japan, pp.108–110.

As described in the above-given literatures, the dyes made of the pyrazoloazole type magenta couplers do not produce any side-absorption. The above-given literatures, U.S. Pat. Nos. 3,725,067, 3,758,309 and 3,810,761 and so forth describe that the couplers of this type are excellent.

However, the light-fastness of azomethine dyes made of the couplers are so seriously low that the characteristics of color photographic light sensitive materials, particularly those of print type color photographic light sensitive materials are seriously spoiled.

The studies and researches have been tried for improving the light-fastness. For example, JP OPI Publication Nos. 59-125732 (1984), 61-282845 (1986), 61-292639 (1986) and 61-279855 (1986) disclose the techniques of making combination use of a pyrazoloazole type coupler and a phenol type compound or a phenylether compound and JP OPI Publication Nos. 61-72246 (1986), 62-208048 (1987), 62-157031 (1987) and 163351 (1988) disclose the techniques of making combination use of a pyrazoloazole type coupler and an amine type compound.

Further, JP OPI Publication No. 63-24256 (1988) proposes for a pyrazoloazole type magenta coupler having an alkyloxyphenyloxy group.

In the above-given techniques, the light-fastness of magenta dye images are still unsatisfactory and the improvements thereof have been eagerly demanded.

SUMMARY OF THE INVENTION

This invention has been made for solving the above-mentioned problems. It is an object of the invention is to provide a silver halide color photographic light sensitive material excellent in color reproducibility and color developability and remarkably improved in light-fastness of magenta dye images.

The silver halide color photographic light sensitive material of the present invention contains a magenta coupler represented by the Formula I, or II, particularly I-a or II-a, or III-a or III-b.

I

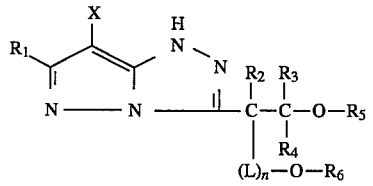

II

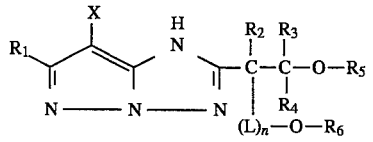

In the formulas $R_1$ is a hydrogen atom or a substituent, $R_2$, $R_3$ and $R_4$ each represents a hydrogen atom or a substituent, L is an alkylene group, n is 0 or 1, $R_5$ and $R_6$ each represents a hydrogen atom or a substituent, where $R_5$ and $R_6$ may be condensed to form a cycle, and X is a hydrogen atom or an atom or a group that can be released upon the reaction with an oxidation product of color developing agent.

I-a

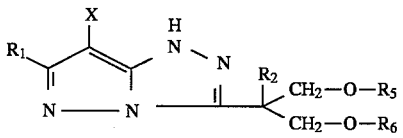

II-a

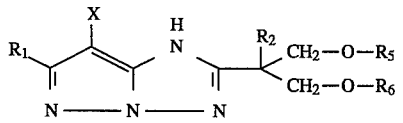

In the formulas $R_1$ is a hydrogen atom or a substituent, $R_2$ represents a hydrogen atom or a substituent, $R_5$ and $R_6$ each represents a hydrogen atom or a substituent, where $R_5$ and $R_6$ may be condensed to form a cycle, and X is a hydrogen atom or an atom or a group that can be released upon the reaction with an oxidation product of color developing agent.

III

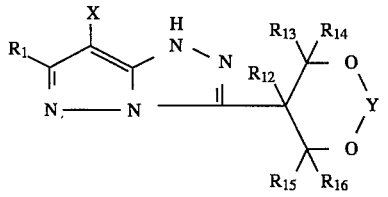

IV

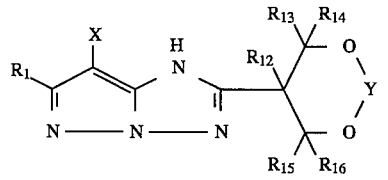

In the formulas $R_{11}$ is a hydrogen atom or a substituent, $R_{12}$, $R_{13}$, $R_{14}$, $R_{15}$ and $R_{16}$ represents a hydrogen atom or a substituent, Y represents a group

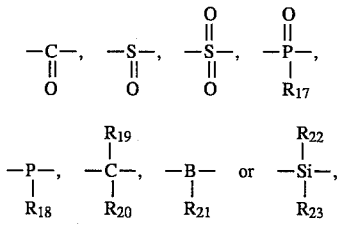

$R_{17}$, $R_{18}$, $R_{19}$, $R_{20}$, $R_{21}$, $R_{22}$ and $R_{23}$ each represents a hydrogen atom or a substituent, where $R_{19}$ and $R_{20}$ may be condensed to form a cycle, and X is a hydrogen atom or an atom or a group that can be released upon the reaction with an oxidation product of color developing agent.

In the above-given Formulas $R_1$ is a hydrogen atom or a substituent. The substituent is selected without specific restriction. The preferable examples thereof include a straight or branched alkyl group having carbon atoms of 1 to 8, for example, a methyl, ethyl, i-propyl, t-butyl, neopentyl and pentadecyl group; a cycloalkyl group having 3 to 10 carbon atoms, for example, a cyclopropyl, cyclopentyl and cyclohexyl group; an alkoxy group such as a methoxy and ethoxy group; an aryloxy group such as a phenoxy and naphtyloxy group; an aryl group such as a phenyl and naphtyl group; an alkylthio group such as methylthio and dodecylthio group; an arylthio group such as a phenylthio group; an acylamino group such as an acetylamino and benzoylamino group; a ureido group such as a phenylcarbamoyl and dimethylcarbamoyl group; an alkoxycarbonylamino group such as an ethoxycarbabonylamino group; an aryloxycarbonyl group such as a phenoxycarbonylamino group; an amino group such as a dimethylamino and anilino group. These groups may have a substituent.

$R_2$, $R_3$ and $R_4$ each represents a hydrogen atom or a substituent. There is no specific limitation in selecting the substituent and preferable example thereof is that mentioned for $R_1$, especially an alkyl group. The preferable example of $R_2$, $R_3$ and $R_4$ is a hydrogen atom and an alkyl group, especially a methyl group.

L is an alkylene group, preferable example of which is a straight or branched alkylene group having 1 to 18 carbon atoms, such as, an methylene, ethylene, 1-methylethylene, 1,1-dimethylpropylene group. The alkylene group may be substituted with any substituting group, example of which includes an aryl group such as a phenyl and naphtyl group; an amino group such as a methylamino, diethylamino and anilino group; a sulfonamide group such as a methanesulfonamide and phenylsulfonamide group; a sulfonyl group such as a butylsulfonyl and phenylsulfonyl group; an alkoxy group such as methoxy and butoxy group; an aryloxy group such as 2-methylphenyloxy, 4-chlorophenyloxy group; an alkylthio group such as an octylthio and isopropyl group; an acylamino group such as a benzoylamino and dodecanoylamino group; an arylthio group such as a phenylthio and 1-naphtylthio group; an alkenyl group such as a vinyl and propenyl group; a cycloalkeny group such as cyclopropyl and cyclohexyl group; a hydroxy group; a carboxy group; a halogen atom such as a bromine and chlorine atom.

There is no specific limitation for a substituent represented by $R_5$ and $R_6$ and typical examples include an alkyl, aryl alkenyl, cycloalkyl, cycloalkenyl, alkynyl, heterocycle, sulfonyl, sulfinyl, phosphonyl, phosphinyl, acyl, carbamoyl, sulfamoyl, alkoxycarbonyl, aryloxycarbonyl group and a spiro compound residual group and hydrocarbon compound residual group having a bridge.

The preferable example of $R_5$ and $R_6$ is hydrogen atom, a sulfonyl group, a phosphonyl group and an acyl group respectively.

In the more preferable embodiment of the invention $R_5$ and $R_6$ are the same.

The alkyl groups mentioned above include, preferably, those having 1 to 32 carbon atoms and they may be straight-chained or branched. As for the aryl groups, a phenyl group or a substituted phenyl group are preferred.

The alkenyl groups mentioned above include, preferably, those having 2 to 32 carbon atoms. The cycloalkyl groups include, desirably, those having 3 to 12 carbon atoms and, preferably, those having 5 to 7 carbon atoms. The alkenyl groups may be straight-chained or branched.

The sulfonyl groups mentioned above include, for example, an alkylsulfonyl group and an arylsulfonyl group;

The sulfinyl groups include, for example, an alkylsulfinyl group and an arylsulfinyl group;

The phosphonyl groups include, for example, an alkylphosphonyl group and an arylphosphonyl group;

The phosphinyl groups include, for example, an alkylphosphinyl group and an arylphosphinyl group;

The acyl groups include, for example, an alkylcarbonyl group and an arylcarbonyl group;

The carbamoyl groups include, for example, an alkylcarbamoyl group and an arylcarbamoyl group;

The sulfamoyl groups include, for example, an alkylsulfamoyl group and an arylsulfamoyl group;

The heterocyclic groups include, preferably, those having 5- to 7-members and, typically, a 2-furyl group, a 2-thienyl group, a 2-pyrimidinyl group and a 2-benzothiazolyl group;

The spiro compound residual groups include, for example, a spiro[3.3]heptane-1-yl; and The hydrocarbon compound residual groups having a bridge include, for example, a bicyclo[2.2.1]heptane-1-yl, tricyclo[3.3.1.1$^{3,7}$]decane-1-yl and 7,7-dimethylbicyclo[2.2.1]heptane-1-yl.

Each of the groups for $R_5$ and $R_6$ include those each further having a substituent.

A preferable example of Y includes

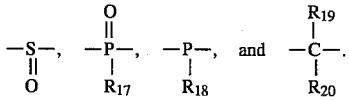

X is an atom or a group capable of splitting off upon reaction with the oxidized product of a color developing agent (a splitting off group). The splitting off group include, for example, a halogen atom and each of the groups of alkoxy, aryloxy, acyloxy, arylthio, alkylthio, sulfonamido, acylamino, and

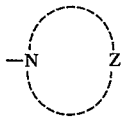

wherein Z is atoms selected from a carbon oxygen, nitrogen, or sulfur atom to complete a 5- or 6 membered cycle with the nitrogen atom.

Examples of the split off groups are illustrated.

Halogen atom: Chlorine, bromine and fluorine atom;

Alkoxy group: Ethoxy, benzyloxy, ethylcarbamoylmethoxy and tetradecylcarbamoylmethoxy group.

Aryloxy group: Phenoxy, 4-methoxyphenoxy and 4-nitrophenoxy group;

Acyloxy group: Acetoxy, myristoyloxy and benzoyloxy group;

Arylthio group: Phenylthio, 2-buthoxy-5-octylphenylthio, and 2,5-dihexylphenylthio group;

Alkylthio group: Methylthio, octylthio, hexadecylthio, benzylthio, 2-(diethylamino)ethylthio, ethoxycarbonylmethylthio, ethoxyethylthio and phenoxyethylthio;

Sulfonamido group: Methanesulfonamido and benzenesulfonamide; Acylamino group: Heptafluorobutaneamido and pentachlorophenylcarbonylamino group.

Group represented by

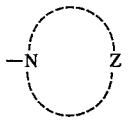

is exemplified.

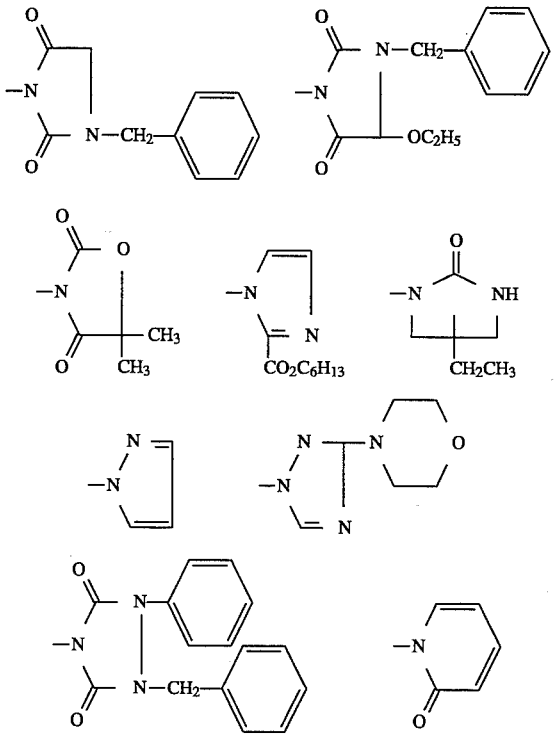

-continued

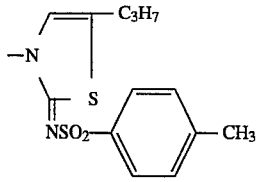

The preferable splitting off group is a halogen atom and more preferably a chlorine atom.

The Formulae III and IV are explained in detail.

$R_{11}$ is a hydrogen atom or a substituent. The substituent is not specifically limited. The preferable examples thereof include a straight or branched alkyl group having carbon atoms of 1 to 18, for example, a methyl, ethyl, i-propyl, t-butyl, neopentyl and pentadecyl group; a cycloalkyl group having 3 to 10 carbon atoms, for example, a cyclopropyl, cyclopentyl and cyclohexyl group; an alkoxy group such as a methoxy and ethoxy group; an aryloxy group such as a phenoxy and naphtyloxy group; an aryl group such as a phenyl and naphtyl group; an alkylthio group such as methylthio and dodecylthio group; an arylthio group such as a phenylthio group; an acylamino group such as an acetylamino and benzoylamino group; a ureido group such as a phenylcarbamoyl and dimethylcarbamoyl group; an alkoxycarbonylamino group such as an ethoxycarbabonylamino group; an aryloxycarbonyl group such as a phennoxycarbonylamino group; an amino group such as a dimetylamino and anilino group. These groups may have a substituent.

$R_{12}$, $R_{13}$, $R_{14}$, $R_{15}$, $R_{16}$, $R_{17}$, $R_{18}$, $R_{19}$, $R_{20}$, $R_{21}$, $R_{22}$ and $R_{23}$ is a hydrogen atom or a substituent. The substituent is not specifically limited and example thereof includes those exemplified for $R_{11}$. As for $R_{12}$ to $R_{16}$, $R_{19}$, $R_{20}$, $R_{22}$ and $R_{23}$ an unsubstituted or substituted alkyl is especially preferable. As for $R_{17}$, $R_{18}$ and $R_{21}$ an alkyl aryl, alkoxy and aryloxy group is preferable.

The representative examples of the magenta coupler are illustrated.

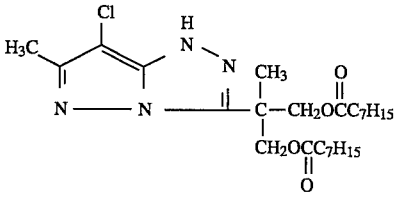

M-1

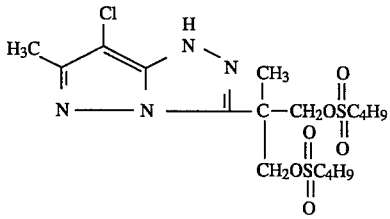

M-2

-continued
M-3
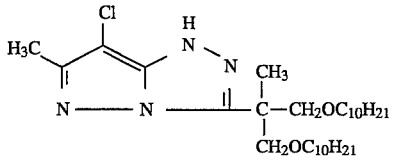
M-4
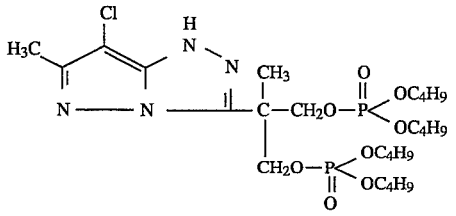
M-5
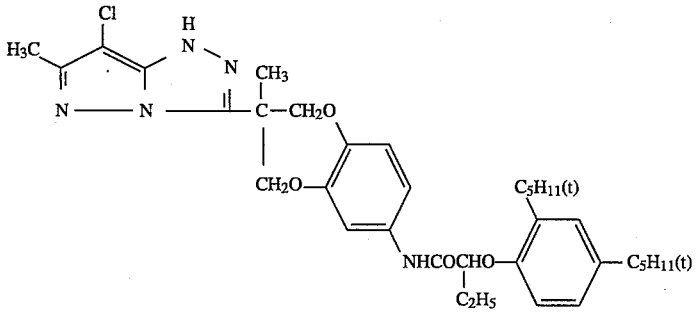
M-6
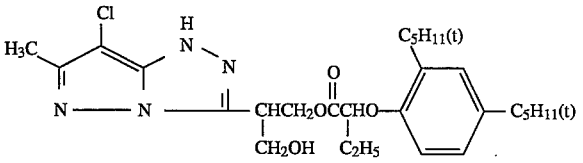
M-7
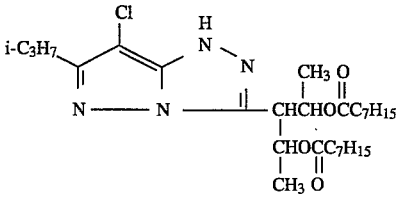
M-8
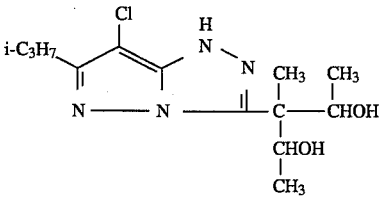
M-9
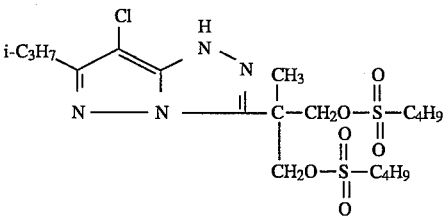
M-10
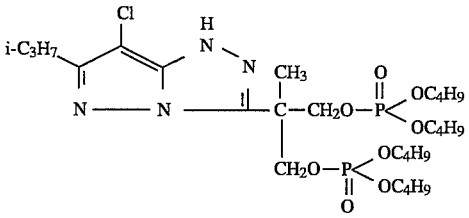
M-11
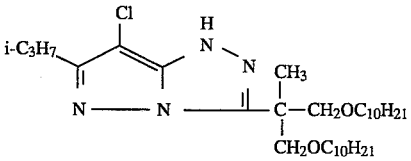
M-12
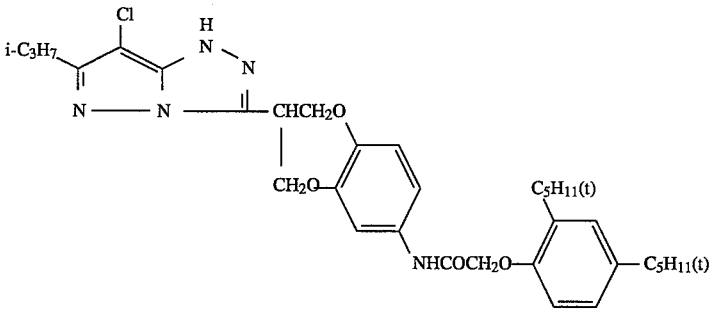

-continued
M-13
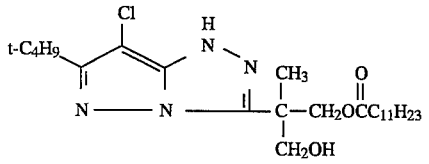
M-14
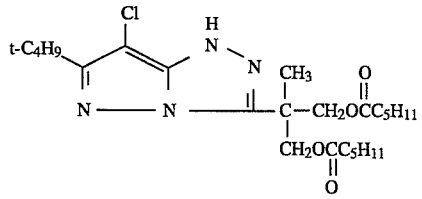
M-15
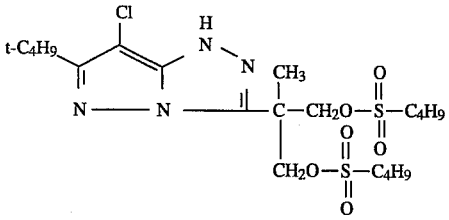
M-16
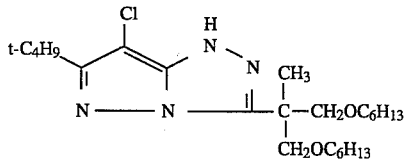
M-17
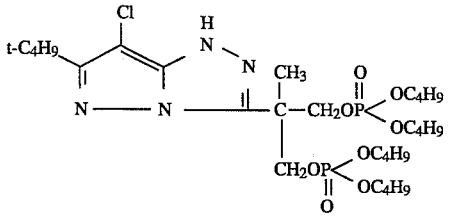
M-18
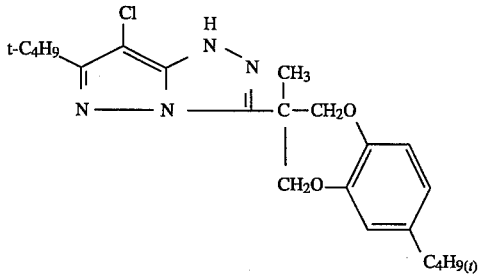
M-19
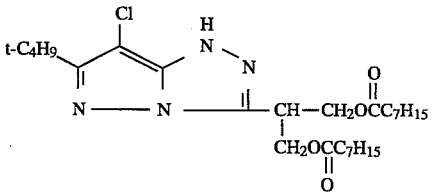
M-20
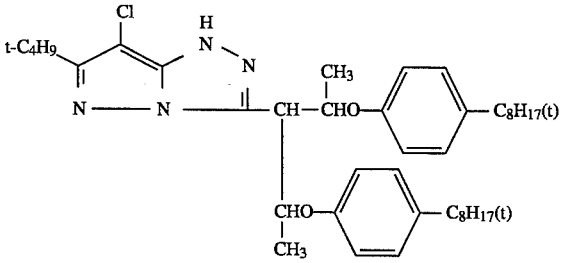
M-21
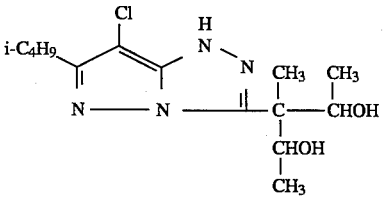
M-22
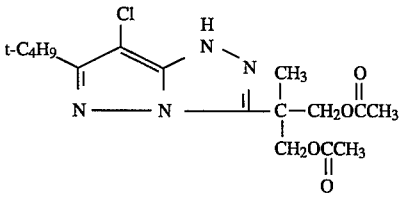
M-23
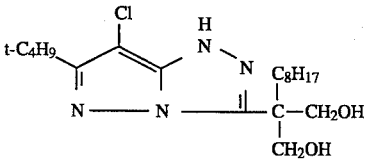
M-24
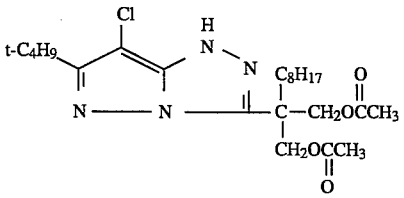

-continued
M-25
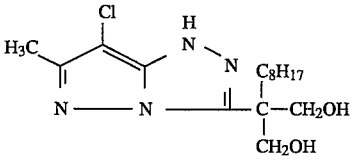
M-26
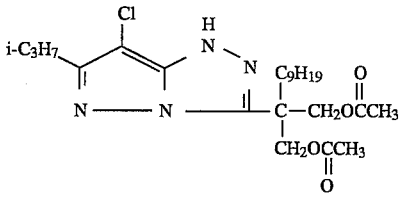
M-27
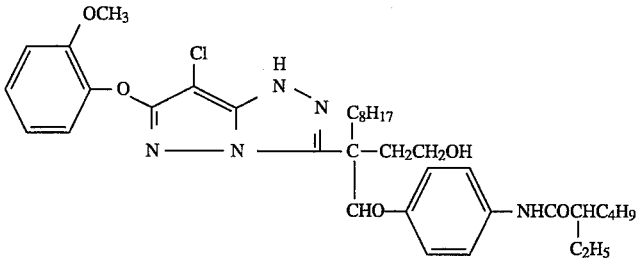
M-28
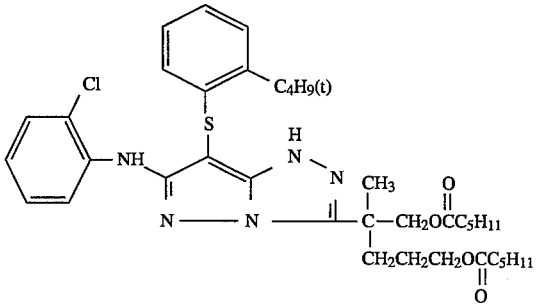
M-29
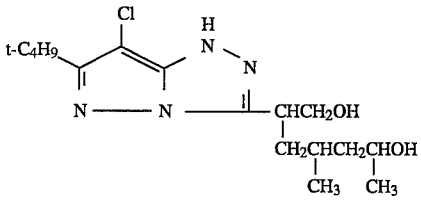
M-30
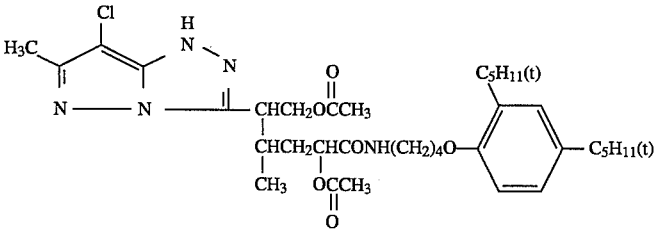
M-31
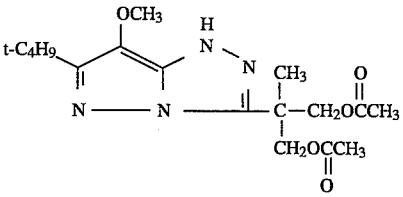
M-32
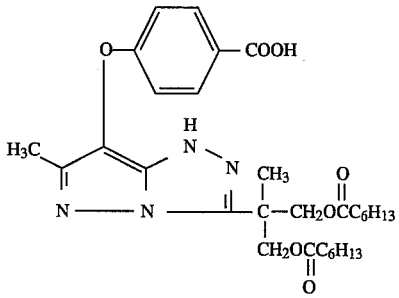
M-33
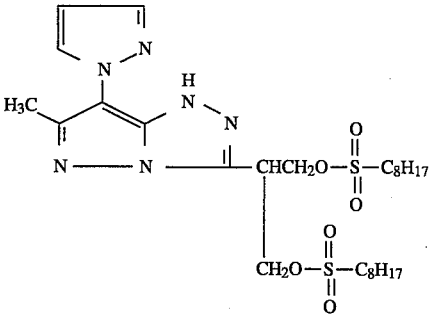
M-34
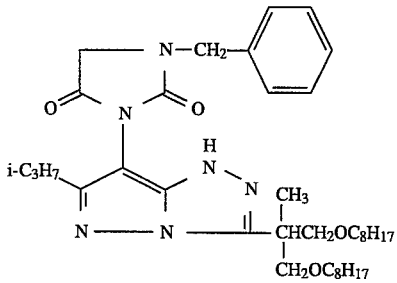

-continued
M-35
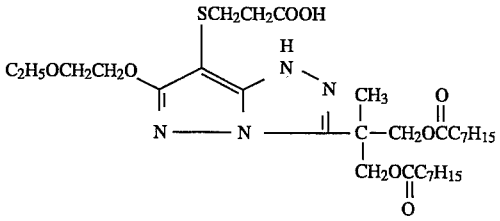
M-36
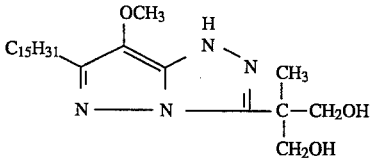
M-37
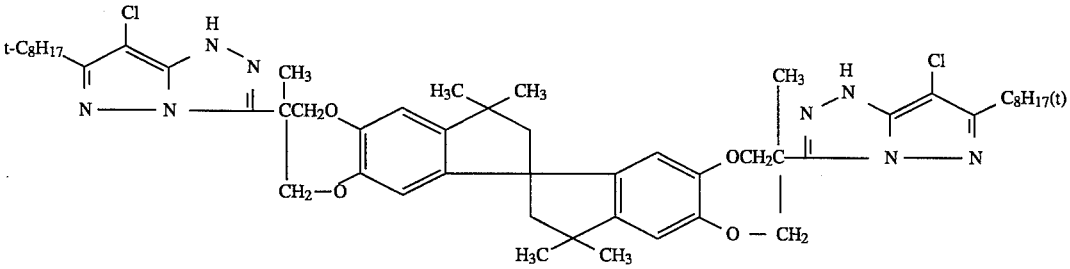
M-38
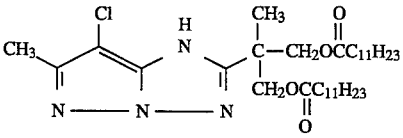
M-39
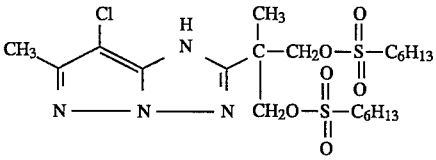
M-40
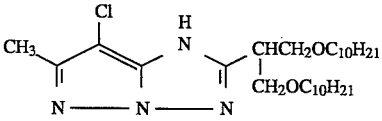
M-41
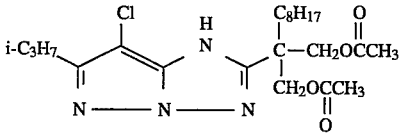
M-42
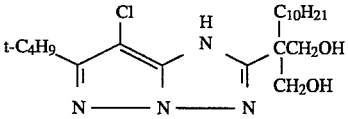
M-43
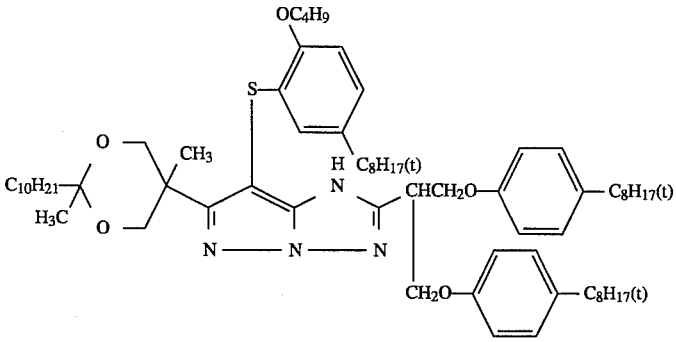
M-44
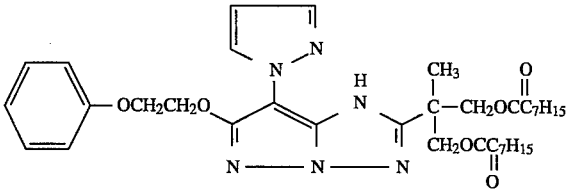
M-45
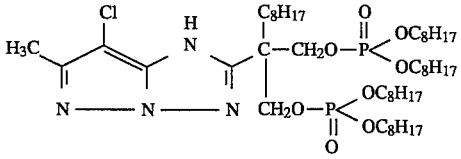

-continued
M-46
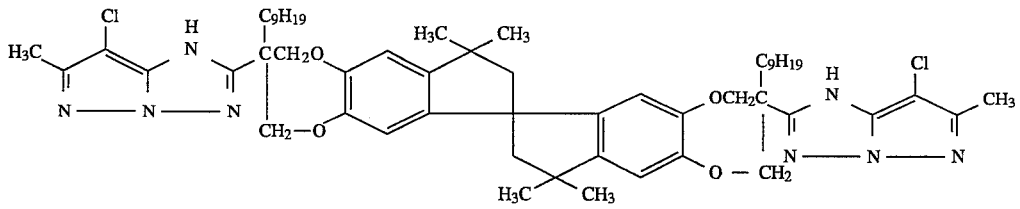
M-47
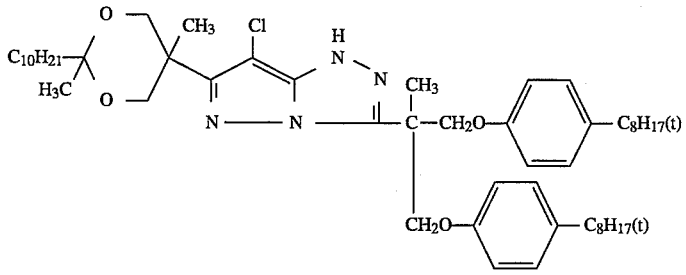
M-48
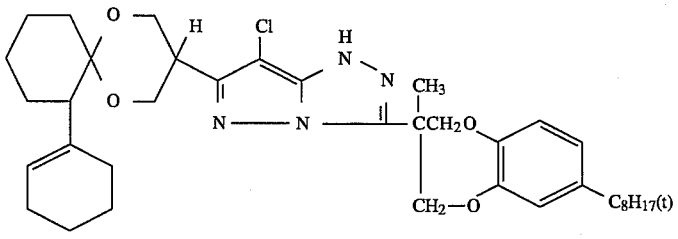
M-49
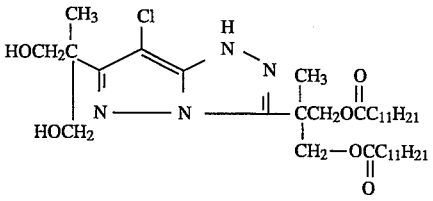
M-50
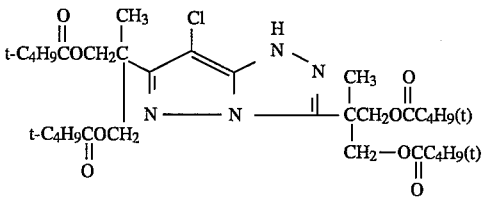
M-51
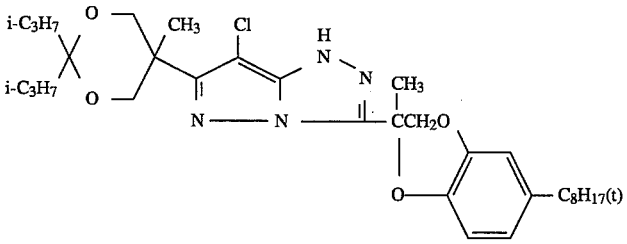
M-52
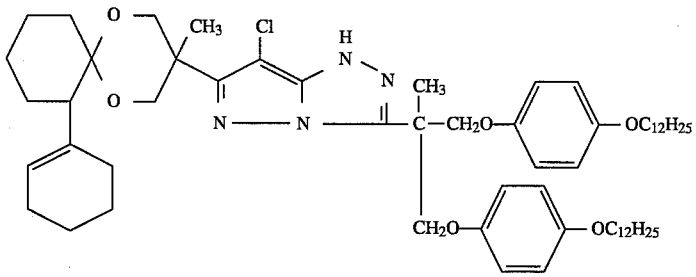

-continued
M-53
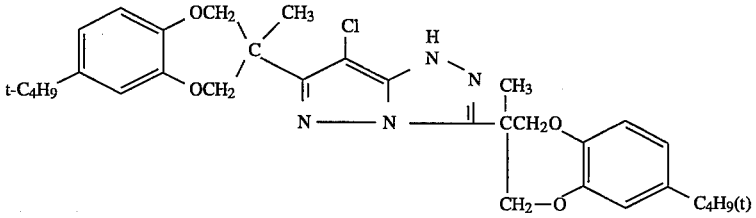
M-54
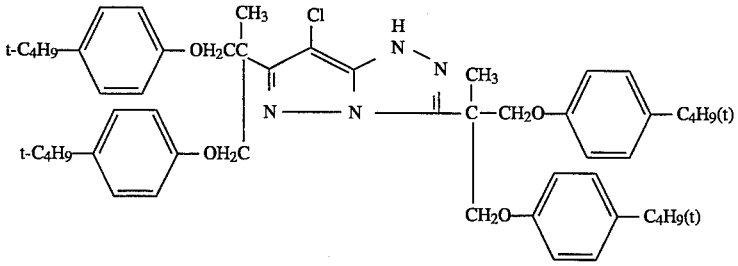
M-55
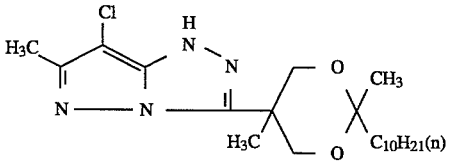
M-56
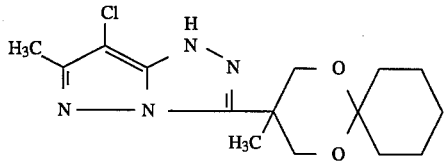
M-57
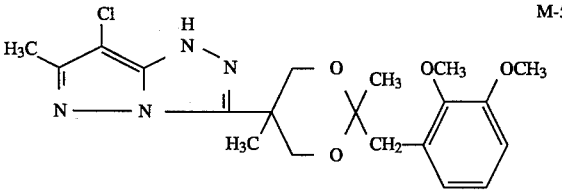
M-58
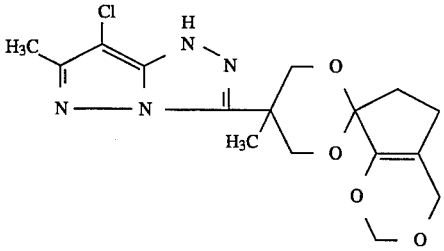
M-59
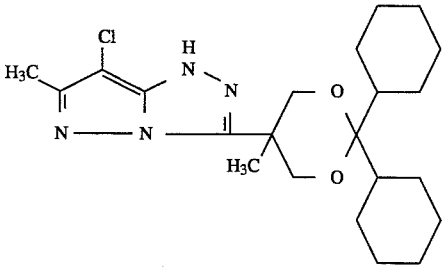
M-60
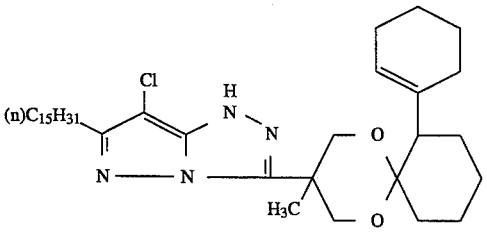
M-61
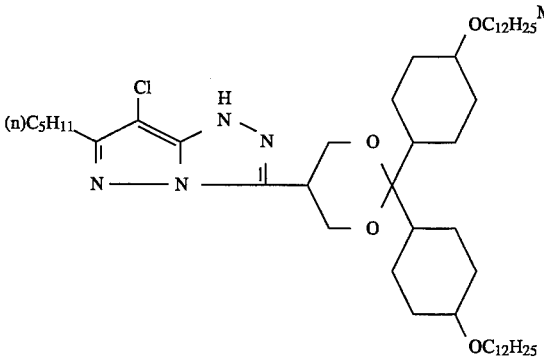
M-62
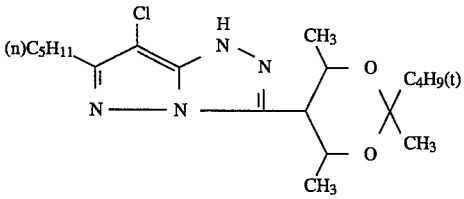

-continued
M-63
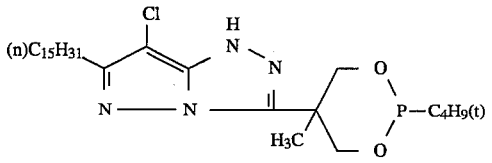
M-64
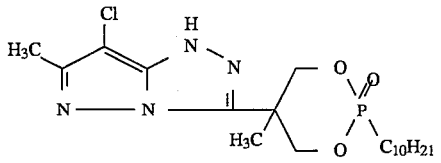
M-65
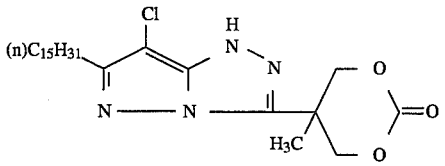
M-66
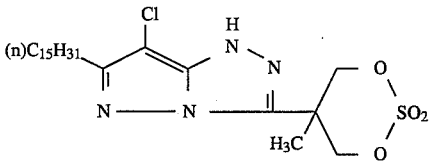
M-67
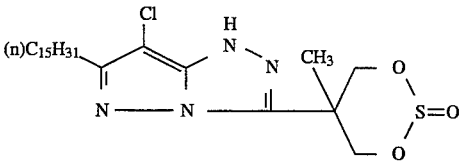
M-68
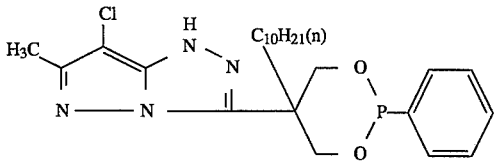
M-69
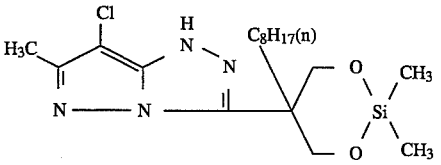
M-70
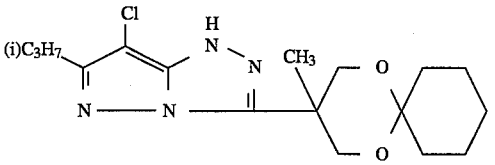
M-71
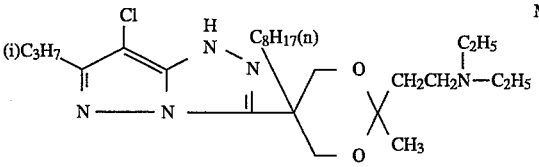
M-72
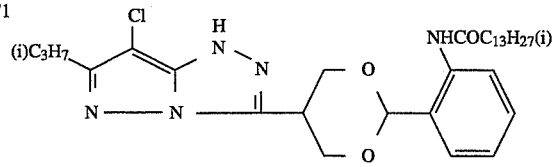
M-73
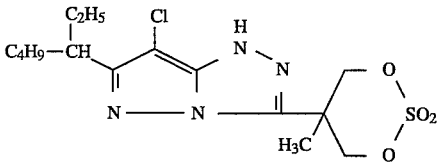
M-74
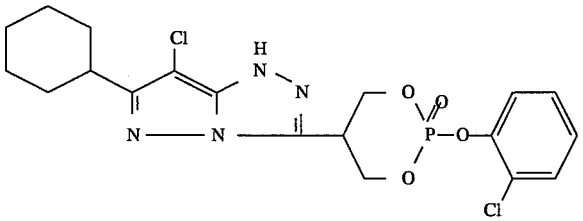
M-75
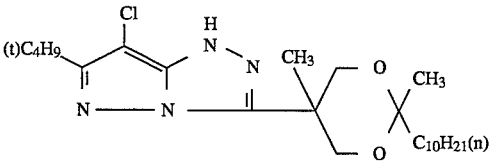
M-76
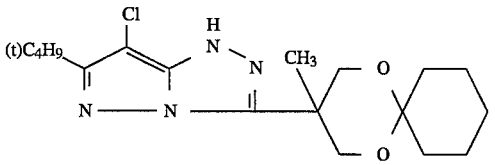
M-77
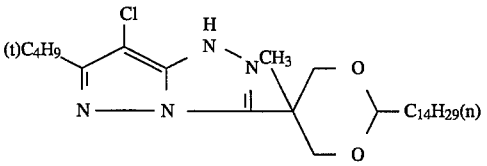

-continued
M-78
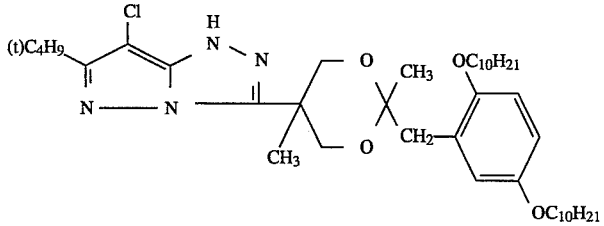
M-79
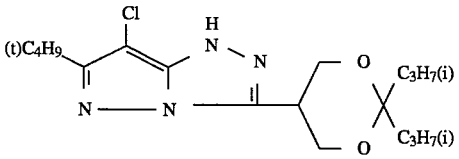
M-80
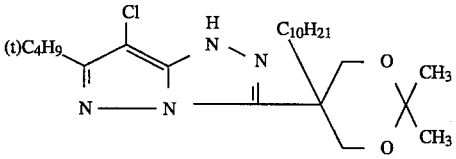
M-81
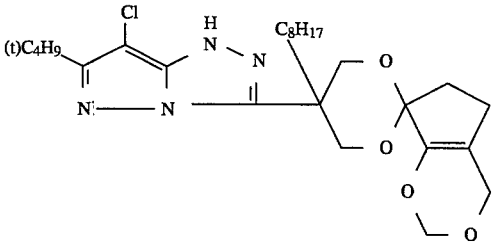
M-82
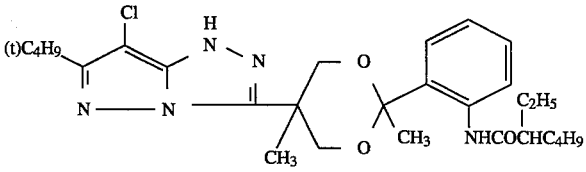
M-83
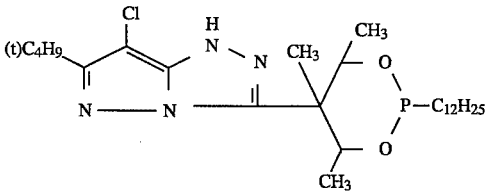
M-84
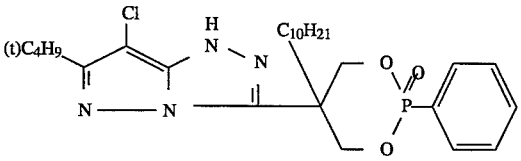
M-85
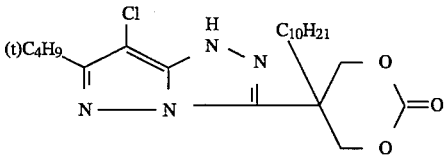
M-86
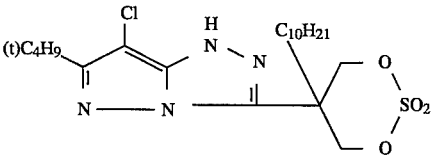
M-87
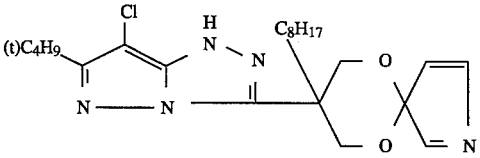
M-88
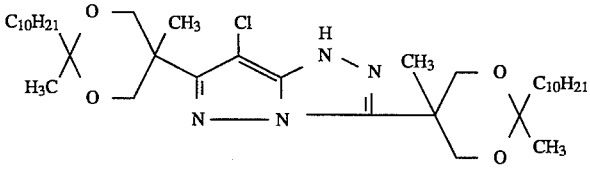

-continued
M-89
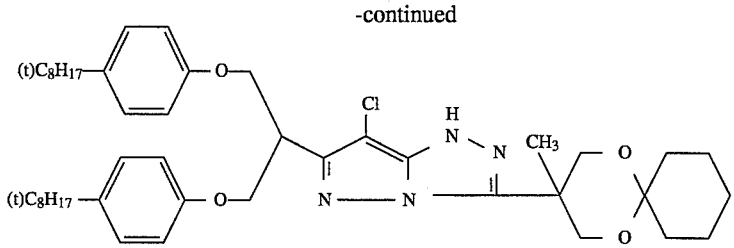
M-90
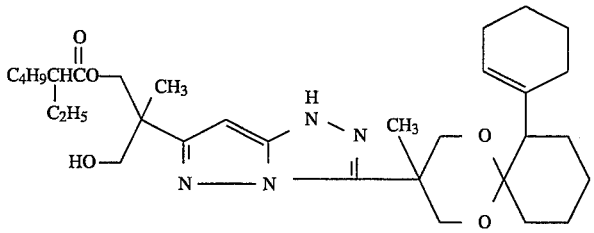
M-91
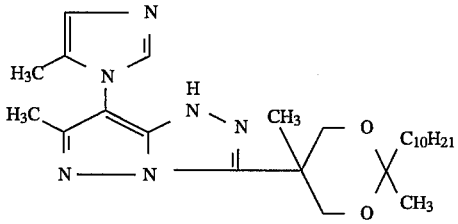
M-92
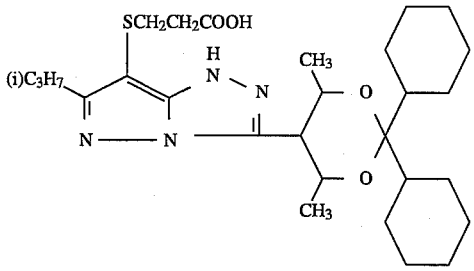
M-93
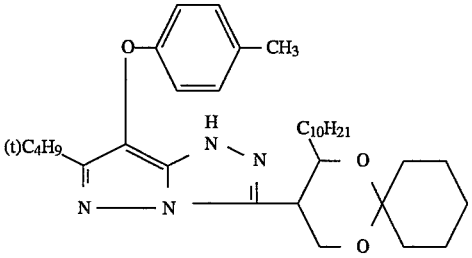
M-94
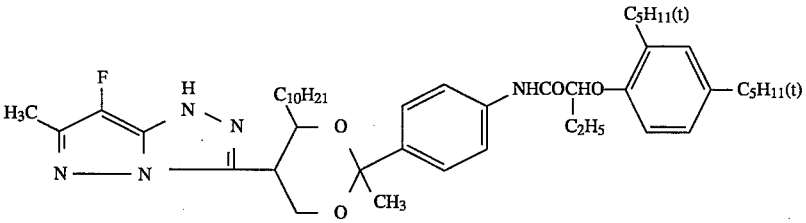
M-95
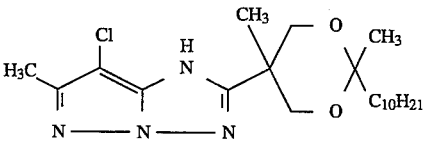
M-96
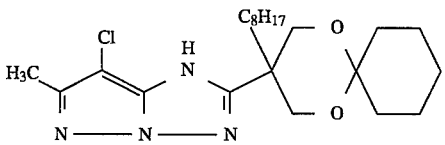
M-97
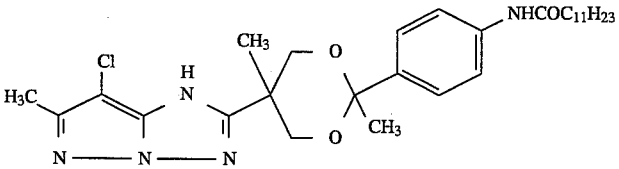

-continued
M-98
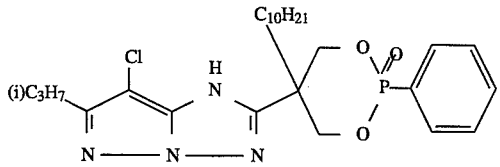
M-99
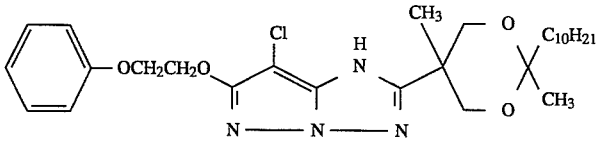
M-100
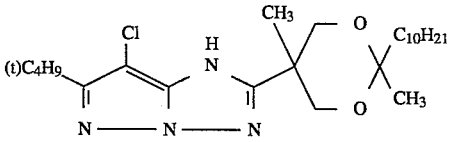
M-101
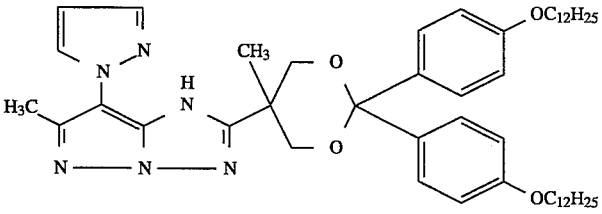
M-102
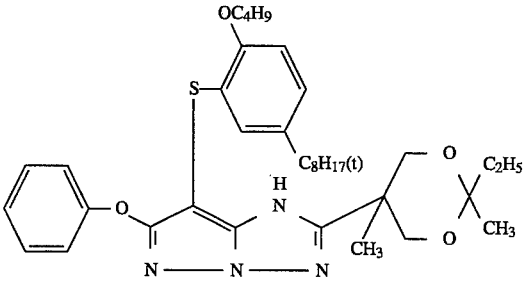
M-103
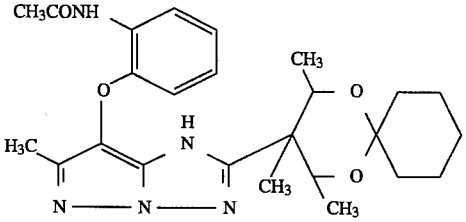
M-104
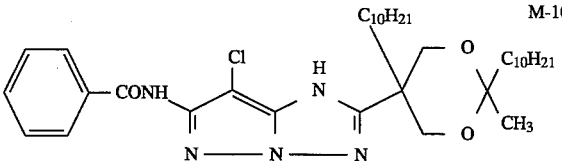
M-105
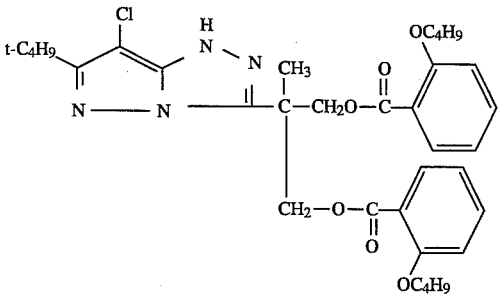

-continued

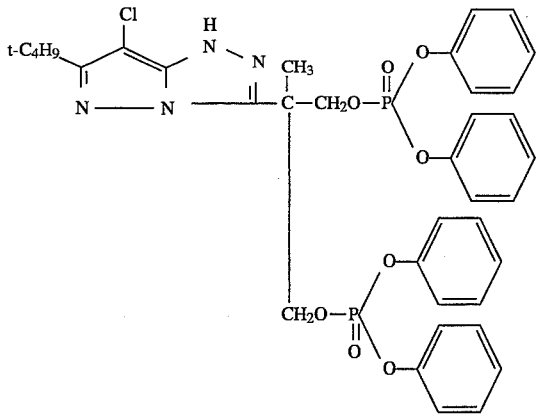

M-106

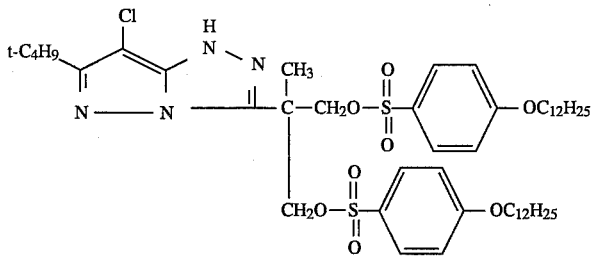

M-107

The typical synthesizing examples of the above-mentioned pyrazoloazole type magenta couplers relating to the invention will now be given below.

SYNTHESIS EXAMPLE

Synthesis of Exemplified Compound M-14

Synthesis Procedures

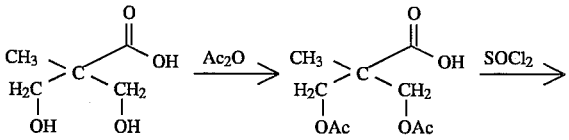

2,2-bis(hydroxymethyl)-propionic acid

Intermediate 1

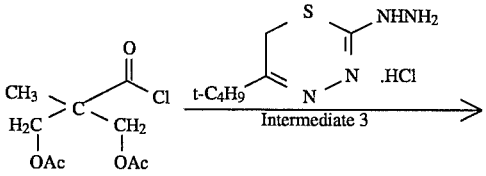

Intermediate 2

Intermediate 3

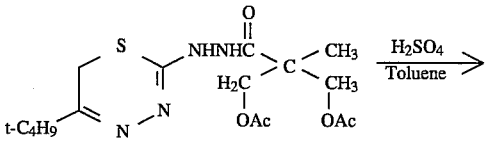

Intermediate 4

-continued

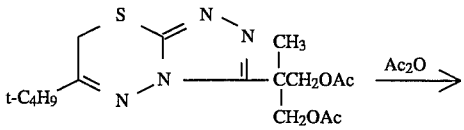

Intermediate 5

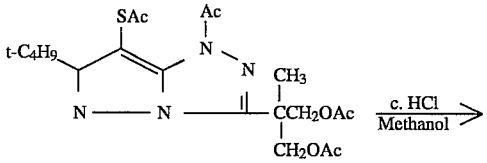

Intermediate 6

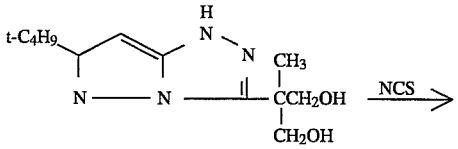

Intermediate 7

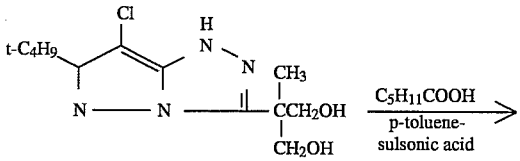

Intermediate 8

-continued

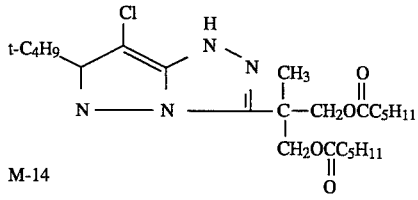

M-14

Synthesis of Intermediate 1

To 2,2-bis(hydroxymethyl)propionic acid of 40.2 g, 120 ml of acetic acid anhydrite are added and they are allowed to stir for 2 hours at 70° C. The reactant was poured into a mixture of 10 ml of 0.6 N hydrochloric acid and 100 g of ice and the resultant was extracted by adding 300 ml of ethylacetate after stirring for one hour. Obtained organic phase was washed with water twice, dried with magnesium sulfate anhydrite, and then solvent of the organic phase was removed by evaporation at reduced pressure. The obtained oily result was recrystallized from toluene to give the Intermediate 1 of white crystal in an amount of 47.4 g. The chemical structure was confirmed by $^1$HNMR, IR spectroscopic analysis and FD mass spectroscopic analysis.

Synthesis of Intermediate 5

After mixture of 200 ml of toluene and 47 ml of thionyl chloride was added to 47.4 g of the Intermediate 1, they were refluxed with heating for 4 hours. Toluene and excess thionyl chloride were removed by evaporation to obtain the Intermediate 2 of brown oil in an mount of 51.4 g.

To the Intermediate 3 in an amount of 43.5g, 450 ml of acetonitrile and 51.4 g of the Intermediate 2 were added and they were refluxed with heating for 3 hours and cooled to room temperature. After removing organic solvent, to the resulted oily product 400 ml of toluene and 6 ml of concentrated sulfuric acid were added, and they were refluxed with heating for 2 hours. After the reaction liquid was cooled to room temperature, 500 ml of ethyl acetate was added thereto, and further sodium hydrogen carbonate was added until the water phase becomes to show weak alkaline, and then organic phase was separated. The resulted organic phase was washed with water, dried with magnesium sulfate anhydrite, and solvent was removed by evaporation at reduced pressure. The resultant was refined through silica gel chromatography to obtain 54.6 g of pale yellow oil Intermediate 6.

The chemical structure was confirmed by $^1$HNMR, IR spectroscopic analysis and FD mass spectroscopic analysis.

Synthesis of Intermediate 7

To 54.6 g of the Intermediate 5, 300 ml of acetic acid anhydrite was added, excess acetic acid anhydrite was removed at normal pressure after refluxed with heating for 3 hours. To the resultant, 200 ml of methanol was added and further 60 ml of concentrated sulfuric acid was added dropwise. They were refluxed with heating for 3 hours. After the reaction the reaction liquid was cooled to room temperature, and was kept standing for a day after removing deposited crystal sulfur by filtration. Deposited crystal was separated by filtration to obtain 46 g of crystal, to the crystal, 1000 ml of ethylacetate and 80 ml of saturated aqueous solution of sodium hydrogen carbonate, and they were stirred with heating for 1 hour. Then the organic phase was dried and organic solvent was removed therefrom by evaporation at reduced pressure. The resultant was refined by crystallization from a mixture solvent of ethyl acetate and hexane to obtain 38.3 g of white crystal Intermediate 7.

The structure thereof was confirmed by $^1$HNMR, FD mass-spectral analysis and IR spectral analysis.

Synthesis of Exemplified Compound M-14

After dissolving 38.3 g of the Intermediate 7 in 300 ml of tetrahydrofuran, the solution was cooled to 5° C. To the solution 15.2 g of N-chlorosumlinimide was added as a solid state little by little, the mixture was stirred for 2 hours at 5° to 7° C. After removing solvent by evaporation at reduce pressure to the reactant 700 ml of ethylacetate and 150 ml of water was added then organic phase is separated. The organic phase was dried and therefrom ethyl acetate was removed by evaporation at reduced pressure. The resultant was recrystallized from a mixture solvent of ethylacetate and hexane to obtain 41.8 g of the Intermediate 8.

After addition of 31.8 g of n-hexane, 300 ml of toluene and 15.0 g of p-toluenesufonic acid to 41.9 g of the Intermediate 8, the mixture was refluxed with heating for 15 hours, was cooled to room temperature thereafter, and the organic phase was separated after adding 300 ml of water. The separated organic phase was washed with aqueous solution of sodium hydrogen carbonate, and was dried with magnesium sulfite anhydrite, and organic solvent was removed by evaporation at reduced pressure. The obtained oily product was refined through silica gel chromatography and further was recrystallized from a mixture solvent of ethylacetate and hexane to obtain 40.7 g of white crystal M-14.

The structure thereof was confirmed by $^1$HNMR, FD mass-spectral analysis and IR spectral analysis.

Synthesis of Exemplified Compound M-75

Synthesis Procedures

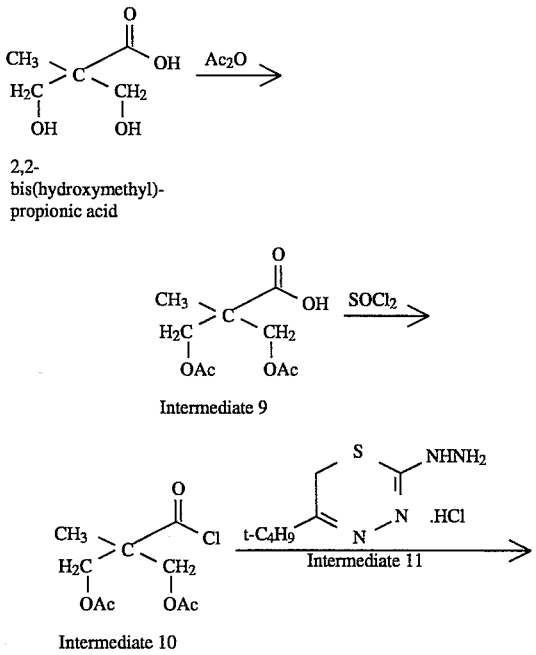

-continued

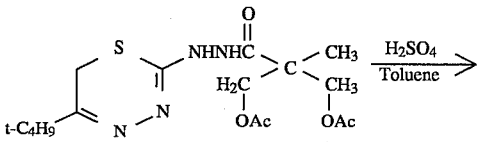

Intermediate 12

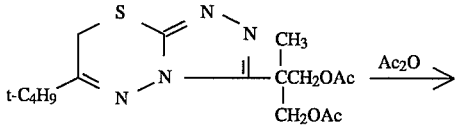

Intermediate 13

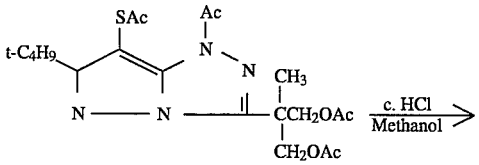

Intermediate 14

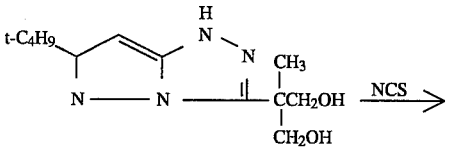

Intermediate 15

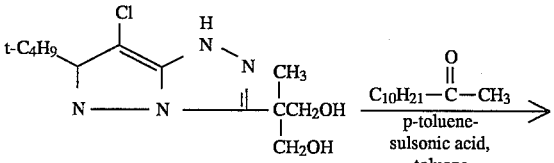

Intermediate 16

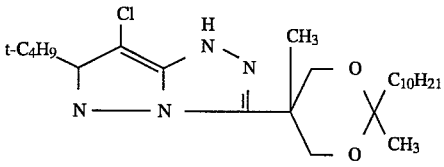

M-75

Synthesis of Intermediate 9

To 2,2-bis(hydroxymethyl)propionic acid of 40.2 g, 120 ml of acetic acid anhydrite are added and they are allowed to stir for 2 hours at 70° C. The reactant was poured into a mixture of 10 ml of 0.6 N hydrochloric acid and 100 g of ice and the resultant was extracted by adding 300 ml of ethylacetate after stirring for one hour. Obtained organic phase was washed with water twice, dried with magnesium sulfate anhydrite, and then solvent of the organic phase was removed by evaporation at reduced pressure. The obtained oily result was recrystallized from toluene to give the Intermediate 9 of white crystal in an amount of 47.4 g. The chemical structure was confirmed by $^1$HNMR, IR spectroscopic analysis and FD mass spectroscopic analysis.

Synthesis of Intermediate 13

After mixture of 200 ml of toluene and 47 ml of thionyl chloride was added to 47.4 g of the Intermediate 9, they were refluxed with heating for 4 hours. Toluene and excess thionyl chloride were removed by evaporation to obtain the Intermediate 10 of brown oil in an mount of 51.4 g.

To the Intermediate 11 in an amount of 43.5g, 450 ml of acetonitrile and 51.4 g of the Intermediate 10 were added and they were refluxed with heating for 3 hours and cooled to room temperature. After removing organic solvent, to the resulted oily product 400 ml of toluene and 6 ml of concentrated sulfuric acid were added, and they were refluxed with heating for 2 hours. After the reaction liquid was cooled to room temperature, 500 ml of ethyl acetate was added thereto, and further sodium hydrogen carbonate was added until the water phase becomes to show weak alkaline, and then organic phase was separated. The resulted organic phase was washed with water, dried with magnesium sulfate anhydrite, and solvent was removed by evaporation at reduced pressure. The resultant was refined through silica gel chromatography to obtain 54.6 g of pale yellow oil Intermediate 13.

The chemical structure was confirmed by $^1$HNMR, IR spectroscopic analysis and FD mass spectroscopic analysis.

Synthesis of Intermediate 15

To 54.6 g of the Intermediate 13, 300 ml of acetic acid anhydrite was added, excess acetic acid anhydrite was removed at normal pressure after refluxed with heating for 3 hours. To the resultant, 200 ml of methanol was added and further 60 ml of concentrated sulfuric acid was added dropwise. They were refluxed with heating for 3 hours. After the reaction the reaction liquid was cooled to room temperature, and was kept standing for a day after removing deposited crystal sulfur by filtration. Deposited crystal was separated by filtration to obtain 46 g of crystal, to the crystal, 1000 ml of ethylacetate and 80 ml of saturated aqueous solution of sodium hydrogen carbonate, and they were stirred with heating for 1 hour. Then the organic phase was dried and organic solvent was removed therefrom by evaporation at reduced pressure. The resultant was refined by crystallization from a mixture solvent of ethyl acetate and hexane to obtain 38.3 g of white crystal Intermediate 15.

The structure thereof was confirmed by $^1$HNMR, FD mass-spectral analysis and IR spectral analysis.

Synthesis of Exemplified Compound M-75

After dissolving 38.3 g of the Intermediate 15 in 300 ml of tetrahydrofuran, the solution was cooled to 5° C. To the solution 15.2 g of N-chlorosumlinimide was added as a solid state little by little, the mixture was stirred for 2 hours at 5° to 7° C. After removing solvent by evaporation at reduce pressure to the reactant 700 ml of ethylacetate and 150 ml of water was added then organic phase is separated. The organic phase was dried and therefrom ethyl acetate was removed by evaporation at reduced pressure. The resultant was recrystallized from a mixture solvent of ethylacetate and hexane to obtain 41.9 g of the Intermediate 16.

After addition of 15.4 g of 2-dodecanone, 800 ml of toluene and 5.2 g of p-toluenesufonic acid to 10.0 g of the Intermediate 16, the mixture was refluxed with heating for 8 hours, was cooled to room temperature thereafter, and was washed with 5% aqueous solution of sodium hydrogen carbonate, and organic solvent was removed by evaporation at reduced pressure. The obtained oily product was refined through silica gel chromatography to obtain 8.9 g of pale oil M-75.

The chemical structure thereof was confirmed by $^1$HNMR, FD mass-spectral analysis and IR spectral analysis.

It is preferred to contain the magenta coupler in a silver halide emulsion. The magenta coupler may be contained therein in a well-known method. For example, the magenta coupler relating to the invention can be contained in a silver halide emulsion in the following manner. The magenta coupler of the invention is dissolved in a high boiling organic solvent having a boiling point of not lower than 175° C. such as tricresyl phosphate and dibutyl phthalate or a low boiling solvent such as ethyl acetate and butyl propionate independently or, if required, in the mixture thereof independently or in combination, and the resulting solution is mixed with an aqueous gelatin solution containing a surfactant. After that, the resulting mixture is emulsified by making use of a high-speed rotary mixer or a colloid-mill and the emulsified mixture is then added into the silver halide emulsion.

The magenta coupler of the invention may usually be used in an amount within the range of $1\times10^{-3}$ to 1 mol and, preferably, $1\times10^{-2}$ to $8\times10^{-1}$ mols per mol of silver halide.

It is also allowed to use the magenta couplers of the invention with other kinds of magenta couplers in combination.

It is further allowed to use the magenta couplers of the invention with an image stabilizer. The preferable examples of the stabilizer include phenol compounds, phenylether compounds, amine compounds, and chlate compounds, and concretely, the exemplified compounds GG-1 through G-54, disclosed in pages 133–137 of JP OPI Publication No. 62-215272, the exemplified compounds (a-1) to (a-8), (b-1) to (b-6), (c-1) to (c-7), IIIa-1 to IIIa-15, IV-1 to IV-22, V-1 to V-10 and VI-1 to VI-5 disclosed in pages 23 to 29 of JP OPI Publication No. 4-95952, the exemplified compounds A-1 to A-28 disclosed in pages 11 to 13 of JP OPI Publication No. 60-262159, the exemplified compounds PH-1 to PH-29 disclosed in pages 8–10 of JP OPI Publication No. 61-145552, the exemplified compounds B-1 to B-21 disclosed in pages 6–7 of JP OPI Publication No. 1-306846, the exemplified compounds I-1 to I-13, I'-1 to I'-8, II-1 to II-12, II-1 to II-21, III-8 to III-14, IV-1 to IV-24, and V-1 to V-17 disclosed in pages 10–18 of JP OPI Publication No. 2-958, the exemplified compounds II-1 to II-33 disclosed in pages 10–11 of JP OPI Publication No. 3-39956, the exemplified compounds B-1 to B-65 disclosed in pages 8–11 of JP OPI Publication No. 2-167543, and the exemplified compounds (1) to (120) disclosed in pages 4–7 of JP OPI Publication No. 63-95439.

The image stabilizers may be used in an amount of, desirably, 5 to 400 mol % and, preferably, 10 to 250 mol % of the pyrazoloazole type magenta couplers of the invention.

It is desired that the pyrazoloazole type magenta couplers of the invention and the above-mentioned image stabilizers are used in one and the same layer. It is, however, allowed to use the image stabilizers in the layer adjacent to a layer containing the above-mentioned couplers.

The silver halides desirably used in the invention are comprised of silver chloride, silver chlorobromide or silver chloroiodobromide and, further, they may also be comprised of a combined mixture such as the mixture of silver chloride and silver bromide.

The preferable silver halide component of the silver halide emulsion used in the present invention includes silver chloride, silver chlorobromide or silver chloroiodobromide. The emulsion may be a mixture of, for example, silver chlioride and silver bromide.

In the silver halide emulsions applicable to the invention, it is allowed to use any one of silver halides such as silver bromide, silver iodobromide, silver iodochloride, silver chlorobromide, silver chloroiodobromide and silver chloride which can be used in ordinary silver halide emulsions.

The silver halide grains may be either those having the uniform distribution of silver halide compositions inside the grains or those of the core/shell type having the different silver halide compositions between the inside of the grains and the surface layers of the grains.

The silver halide grains may be either those capable of forming a latent image mainly on the surfaces thereof or those capable of forming a latent image mainly inside the grains thereof.

The silver halide grains may be either those having a regular crystal form such as a cube, octahedron or tetradecahedron or those having an irregular crystal form such as a globular or tabular form. It is allowed to use the grains having any ratios of {100} planes to {111} planes.

These grains may also have a mixed crystal form or may be mixed with the grains having various crystal forms.

The silver halide grains applicable there to are to have a grain size within the range of, desirably, 0.05 to 30 μ and, preferably, 0.1 to 20 μ.

The silver halide emulsions having any grain size distributions may be used. It is, therefore, allowed to use either the emulsions having a wide grain size distribution (hereinafter referred to as 'polydisperse type emulsions') or the independent or mixed emulsions having a narrow grain size distribution (hereinafter referred to as 'monodisperse type emulsions'). It is, further, allowed to use the mixtures of the polydisperse type and monodisperse type emulsions.

The couplers applicable to the invention include a colored coupler capable of displaying a color compensation effect and the compounds capable of releasing a photographically useful fragment such as a development retarder, a development amlelerator, a bleach amlelerator, a developing agent, a silver halide solvent, a color toner, a layer hardener, a foggant, an antifoggant, a chemical sensitizer, a spectral sensitizer and a desensitizer. Among these compounds, it is also allowed to use the so-called DIR compounds capable of releasing a development retarder in the course of carrying out a development and improving the sharpness and graininess of an image.

The above-mentioned DIR compounds include those containing a retarder directly coupled to the coupling position thereof and those containing a retarder coupled to the coupling position through a divalent group and capable of releasing the retarder either upon intramolecular nucteophilic reaction or upon intramolecular electron-transfer reaction, produced in a group split off upon coupling reaction, (the latter compounds are hereinafter referred to as 'timing DIR compounds'). The retarders applicable thereto include those becoming diffusible upon splitting off and those not having a diffusibility so much, independently or in combination so as to meet the purposes of application.

The above-mentioned couplers are to make a coupling reaction with the oxidized products of an aromatic primary amine developing agent and these couplers may also be used in combination with a colorless coupler not forming any dyes (hereinafter referred to as 'competing coupler') as a dye-forming coupler.

The yellow couplers preferably applicable to the invention include, for example, the well-known acylacetanilide type couplers. Among these couplers, benzoyl acetanilide type and pivaloyl acetanilide type compounds may advantageously be used.

The cyan couplers preferably applicable to the invention include, for example, phenol type and naphthol type couplers.

It is also allowed to use a color-fog inhibitor for the purposes of preventing a color stain, a sharpness deterioration and/or a rough graininess, which may be produced by transferring the oxidized products of an developing agent or an electron transferrer between the emulsion layers of a light sensitive material (i.e., between the same color-sensitive layers and/or between the different color-sensitive layers).

An image stabilizer capable of preventing the deterioration of a dye image may be applied to the light sensitive materials of the invention. The compounds preferably applicable thereto are described in, for example, RD 17643, Article VII-J.

For the purposes of preventing any fog from being produced by a electric discharge generated by frictionally static-charging a light sensitive material and preventing an image from being deteriorated by UV rays, a UV absorbent may also be contained in the hydrophilic colloidal layers thereof such as the protective layers and interlayers.

For the purpose of preventing a magenta-dye forming coupler from being deteriorated by formalin in the course of preserving a light sensitive material, a formalin scavenger may further be used in the light sensitive material.

The invention can preferably be applied to a color negative film, a color paper, a color reversal film and so forth.

The invention will be detailed with reference to the following preferred embodiments.

EXAMPLE 1-1

Sample 101 of multilayered silver halide color photographic light sensitive materials was prepared in the manner that over to a polyethylene-laminated paper support containing polyethylene on one side thereof and titanium oxide on the other side thereof, each of the layers having the compositions shown in the following table were coated thereover on the side of the polyethylene layer containing titanium oxide.

The coating solutions were each prepared in the following manner.

Coating solution for the 1st layer

Ethyl acetate of 60 ml was added and dissolved into 26.7 g of yellow coupler (EY-1), 10.0 g of dye-image stabilizer (ST-1), 6.67 g of a dye-image stabilizer (ST-2), 0.67 g of antistaining agent (HQ-1) and 6.67 g of high-boiling organic solvent (DNP). The resulting solution was emulsified and dispersed in 220 ml of an aqueous 10% gelatin solution containing 7 ml of an aqueous 20% surfactant (SU-2) solution by making use of a supersonic homogenizer, so that a yellow coupler dispersed solution could be prepared.

| Layer | Composition | Amount added ($g/m^2$) |
|---|---|---|
| 7th layer (Protective layer) | Gelatin | 1.00 |
| 6th layer (UV abosorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Anti-irradiation dye (AIC-1) | 0.02 |
| 5th layer (Red-sensitive layer) | Gelatin | 1.30 |
| | Red-sensitive silver chlorobromide emulsion (Em-R) | 0.21 |
| | Cyan coupler (EC-1) | 0.24 |
| | Cyan coupler (EC-2) | 0.08 |
| | Dye-image stabilizer (ST-1) | 0.20 |
| | Antistaining agent (HQ-1) | 0.01 |
| | HBS-1 | 0.20 |
| | DOP | 0.20 |
| 4th layer (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |
| 3rd layer (Green-sensitive layer) | Gelatin | 1.40 |
| | Green-sensitive silver chlorobromide emulsion (Em-G) | 0.17 |
| | Magenta coupler (EM-1) | 0.75* |
| | DNP | 0.43 |
| | Dye-image stabilizer (ST-3) | 0.75* |
| | Anti-irradiation dye (AIM-1) | 0.01 |
| 2nd layer (Interlayer) | Gelatin | 1.20 |
| | Antistaining agent (HQ-2) | 0.03 |
| | Antistaining agent (HQ-3) | 0.03 |
| | Antistaining agent (HQ-4) | 0.05 |
| | Antistaining agent (HQ-5) | 0.23 |
| | DIDP | 0.06 |
| | Antimold (F-1) | 0.002 |
| 1st layer (Blue-sensitive layer) | Gelatin | 1.20 |
| | Blue-sensitive silver chlorobromide emulsion (Em-B) | 0.26 |
| | Yellow coupler (EY-1) | 0.80 |
| | Dye-image stabilizer (ST-1) | 0.30 |
| | Dye-image stabilizer (ST-2) | 0.20 |
| | Antistaining agent (HQ-1) | 0.02 |
| | Anti-irradiation dye (AIY-1) | 0.01 |
| | DNP | 0.20 |
| Support | Polyethylene-laminated paper sheet | |

*milli-mol/$m^2$

Amounts of the silver halide emulsions added were each shown in terms of the silver contents.

The chemical structures of the compounds applied to each of the above-mentioned layers were as follows.

EY-1
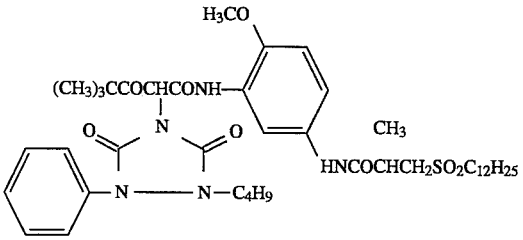
EC-1
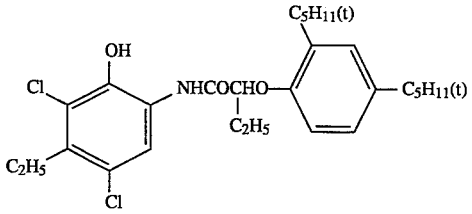
EC-2
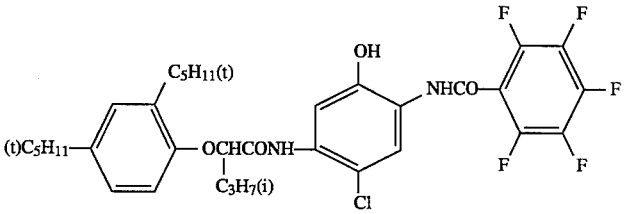
ST-1
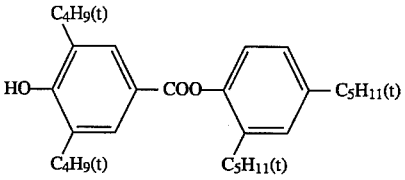
ST-2
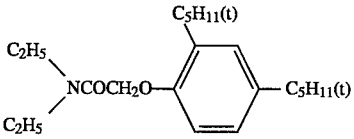
ST-3
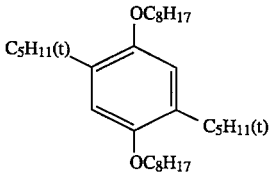
EM-1
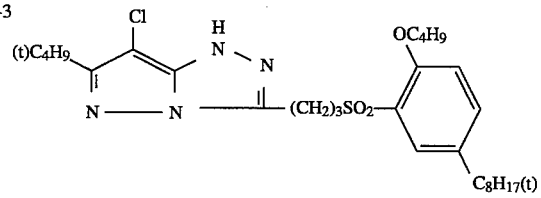
EM-2
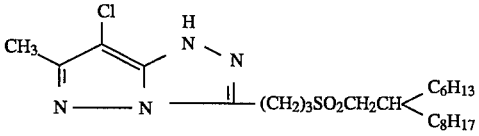
EM-3
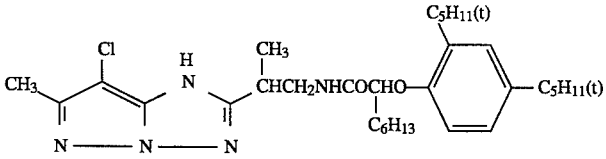
UV-1
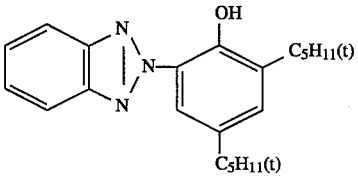
UV-2
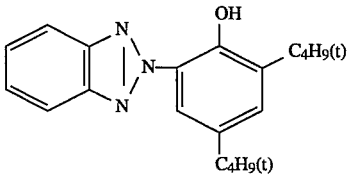
UV-3
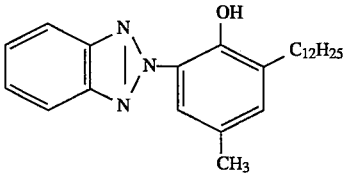
DOP: Dioctyl phthalate
DNP: Dinonyl phthalate
DIDP: Diisodecyl phthalate
PVP: Polyvinyl pyrrolidone HQ-1
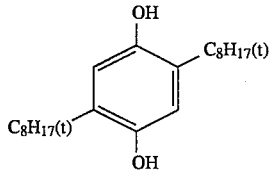
HQ-2
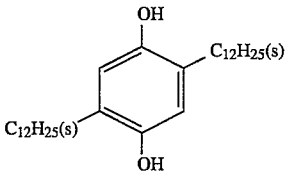
HQ-3
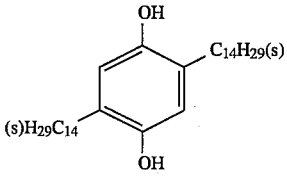
HQ-4
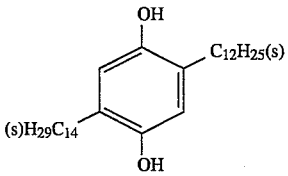
HQ-5
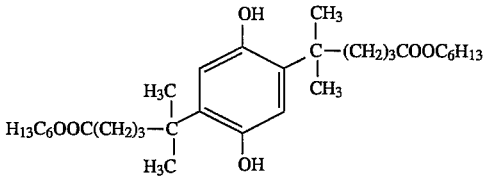
HBS-1
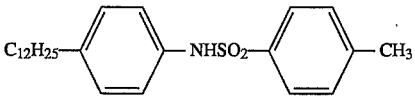
AIM-1
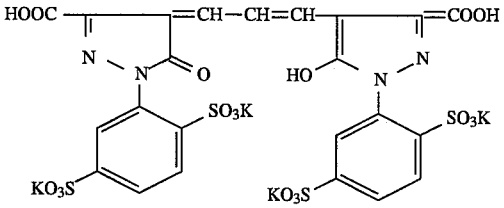
AIC-1
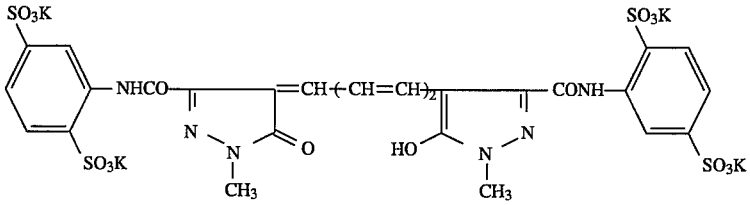
AIY-1
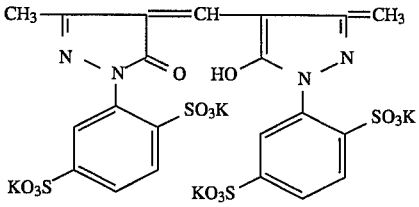
SU-1
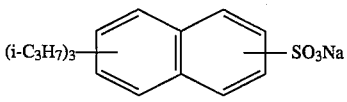
SU-2
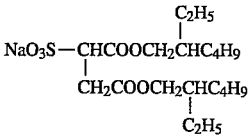
SU-3
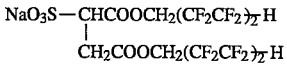
HH-1
$C(CH_2SO_2CH{=}CH_2)_4$
HH-2
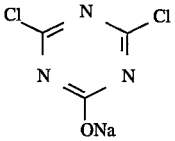
F-1
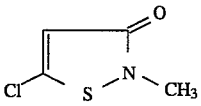

Blue-sensitive silver halide emulsion (Em-B)

This was a monodisperse type cubic silver chlorobromide emulsion having an average grain size of 0.85 μm, a variation coefficient of 0.07 and a silver chloride content of 99.5 mol %.

| | |
|---|---|
| Sodium thiosulfate | 0.8 mg/mol of AgX |
| Chloroauric acid | 0.5 mg/mol of AgX |
| Stabilizer STAB-1 | $6 \times 10^{-4}$ mols/mol of AgX |
| Sensitizing dye BS-1 | $4 \times 10^{-4}$ mols/mol of AgX |
| Sensitizing dye BS-2 | $1 \times 10^{-4}$ mols/mol of AgX |

Green-sensitive silver halide emulsion (Em-G)

This was a monodisperse type cubic silver chlorobromide emulsion having an average grain size of 0.43 μm, a variation coefficient of 0.08 and a silver chloride content of 99.5 mol %.

| | |
|---|---|
| Sodium thiosulfate | 1.5 mg/mol of AgX |
| Chloroauric acid | 1.0 mg/mol of AgX |
| Stabilizer STAB-1 | $6 \times 10^{-4}$ mols/mol of AgX |
| Sensitizing dye GS-1 | $4 \times 10^{-4}$ mols/mol of AgX |

Red-sensitive silver halide emulsion (Em-R)

This was a monodisperse type cubic silver chlorobromide emulsion having an average grain size of 0.50 μm, a variation coefficient of 0.08 and a silver chloride content of 99.5 mol %.

| | |
|---|---|
| Sodium thiosulfate | 1.8 mg/mol of AgX |
| Chloroauric acid | 2.0 mg/mol of AgX |
| Stabilizer STAB-1 | $6 \times 10^{-4}$ mols/mol of AgX |
| Sensitizing dye RS-1 | $1 \times 10^{-4}$ mols/mol of AgX |

The variation coefficient is calculated by the following formulae;

Variation coefficient $$(S/r) = \frac{\text{Standard deviation of grain size distribution}}{\text{Average grain size}}$$

Standard deviation of grain size distribution $$(S) = \sqrt{\frac{\Sigma(r_i - r)^2 n_i}{\Sigma n_i}}$$

Average grain size $$(r) = \frac{\Sigma n_i r_i}{\Sigma n_i},$$

wherein $r_i$ is a grain size of each grain, ans $n_i$ is number of the grains. Grain size means a dimeter of the grain in case that the grain is sphere, or a dimeter of a circle having the same area converted from respective grain in case that the grain is other than sphere such as cubic.

The chemical structures of the compounds applied to each of the monodiserse type cubic emulsions were as follows.

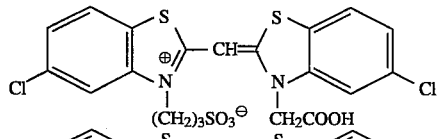

BS-1

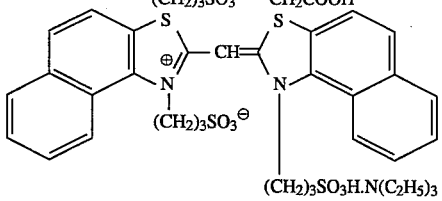

BS-2

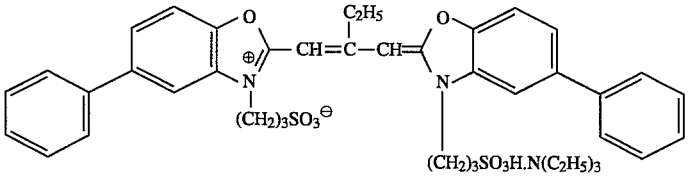

GS-1

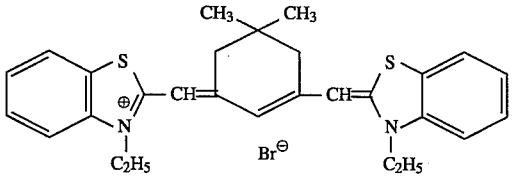

RS-1

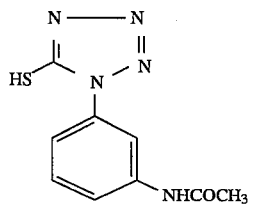

Next, Samples 102 through 113 were each prepared in the same manner as in Sample 101, except that the coupler EM-1 of the 3rd layer was replaced by the same mols of the coupler of the invention shown in Table-3.

The resulting samples were each exposed to green light through a wedge in an ordinary procedures and they were then processed in the following processing steps.

| Processing step | Temperature | Time |
|---|---|---|
| Color developing | 35.0 ± 0.3° C. | 45 sec |
| Bleach-fixing | 35.0 ± 0.5° C. | 45 sec |
| Stabilizing | 30 to 34° C. | 90 sec |
| Drying | 60 to 80° C. | 60 sec |

The compositions of each of the processing solution will be given below.

The processing solutions were each replenished in an amount of 80 ml per $m^2$ of a subject silver halide color photographic light sensitive material.

| Color developer | Tank solution | Replenishing solution |
|---|---|---|
| Deionized water | 800 ml | 800 ml |
| Triethanol amine | 10 g | 18 g |
| N,N-diethyl hydroxyl amine | 5 g | 9 g |
| Potassium chloride | 2.4 g | |
| 1hydroxyethylidene-1,1-diphosphoric acid | 1.0 g | 1.8 g |
| N-ethyl-N-b-methanesulfonamidoethyl-3-methyl-4-aminoaniline sulfate | 5.4 g | 8.2 g |
| Fluorescent whitening agent, (a 4,4'-diaminostilbene sulfonic acid derivative) | 1.0 g | 1.8 g |
| Potassium carbonate | 27 g | 27 g |

Add water to make in total of 1000 ml

Adjust pH values of the tank solution to be 10.0 and of the replenisher to be 10.60, respectively.

Bleach-fixer (The same in both of the tank solution and the replenishing solution)

| | |
|---|---|
| Ferric ammonium ethylenediamine tetraacetate, dehydrate | 60 g |
| Ethylenediaminetetraacetic acid | 3 g |
| Ammonium thiosulfate (in an aqueous 70% solution) | 100 ml |
| Ammonium sulfite (in an aqueous 40% solution) | 27.5 ml |
| Add water to make in total of | 1000 ml |
| Adjust pH with potassium carbonate or glacial acetic acid to be | pH 5.7 |

Stabilizer (The same in both of the tank solution and the replenisher)

-continued

STAB-1

| | |
|---|---|
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (in an aqueous 20% solution) | 3.0 g |
| Fluorescent whitening agent (a 4,4'-diaminostilbene sulfonic acid derivative) | 1.5 g |
| Add water to make in total of | 1000 ml |
| Adjust pH with sulfuric acid or potassium hydroxide to be | pH 7.0 |

The following evaluation were each carried out by making use of the samples which were continuously processed.

<Light-fastness>

The resulting samples were each exposed to a Xenon fade-o-meter for 7 days and the dye image residual percentage (%) thereof at the initial density of 1.0 were found out.

<Dmax>

The maximum color densities thereof were measured.

The results thereof are shown in Table 3.

TABLE 3

| Sample No. | Magenta couplers | Dmax | Light-fastness (residual %) |
|---|---|---|---|
| 101 | EM-1 | 1.96 | 55 |
| 102 | M-13 | 2.15 | 72 |
| 103 | M-14 | 2.35 | 70 |
| 104 | M-15 | 2.24 | 70 |
| 105 | M-18 | 2.07 | 75 |
| 106 | M-24 | 2.20 | 71 |
| 107 | M-54 | 2.41 | 75 |
| 108 | M-75 | 2.20 | 71 |
| 109 | M-77 | 2.09 | 70 |
| 110 | M-80 | 2.18 | 72 |
| 111 | M-82 | 2.23 | 73 |
| 112 | M-84 | 2.15 | 72 |
| 113 | M-88 | 2.24 | 73 |

Samples No.102 through No.113 each shown in Table 3, are improved in both of developability and light-fastness as compared with the comparative sample 101.

EXAMPLE 1-2

Samples No.114 through No.122 were each prepared in the same manner as in Sample No.101 of Example 1-1, except that the magenta coupler in the third layer was replaced with the same mol of each coupler shown in the Table 4.

The same evaluation as Example 1-1 was each carried out by making use of the resulting samples. The results thereof are shown in Table 4.

TABLE 4

| Sample No. | Magenta couplers | Dmax | Light-fastness (residual %) |
|---|---|---|---|
| 114 | EM-2 | 2.44 | 13 |
| 115 | M-1 | 2.57 | 61 |
| 116 | M-4 | 2.53 | 63 |
| 117 | M-6 | 2.49 | 67 |
| 118 | M-7 | 2.51 | 60 |
| 119 | M-55 | 2.54 | 63 |
| 120 | M-61 | 2.51 | 65 |
| 121 | M-64 | 2.48 | 61 |
| 122 | M-60 | 2.57 | 60 |

Samples No.115 through No.122 each shown in Table 4, are remarkably improved in both of developability and light-fastness as compared with the comparative sample 114.

EXAMPLE 1-3

Samples No.123 through No.131 were each prepared in the same manner as in Sample No.101 of Example 1-1, except that the magenta coupler in the third layer was replaced with the same mol of each coupler shown in the Table 5.

The same evaluation as Example 1-1 was each carried out by making use of the resulting samples. The results thereof are shown in Table 5.

TABLE 5

| Sample No. | Magenta couplers | Dmax | Light-fastness (residual %) |
|---|---|---|---|
| 123 | EM-3 | 1.75 | 47 |
| 124 | M-38 | 2.07 | 65 |
| 125 | M-40 | 2.08 | 67 |
| 126 | M-44 | 2.11 | 70 |
| 127 | M-45 | 1.97 | 64 |
| 128 | M-96 | 1.93 | 67 |
| 129 | M-97 | 1.97 | 70 |
| 130 | M-101 | 1.86 | 70 |
| 131 | M-103 | 2.05 | 68 |

Samples No.124 through No. 131 each shown in Table 5, are remarkably improved in both of developability and light-fastness as compared with the comparative sample 123.

EXAMPLE 1-3

The reflective absorption spectrum of Samples 101 to 113 of the Example 1-1 was observed to evaluate spectroscopic absorption characteristics λmax and Abs600. The result is summarised in Table 6.

TABLE 6

| Sample No. | Magenta couplers | λmax | Abs600 |
|---|---|---|---|
| 101 | EM-1 | 547 | 0.42 |
| 102 | M-13 | 548 | 0.34 |
| 103 | M-14 | 545 | 0.36 |
| 104 | M-15 | 548 | 0.35 |
| 105 | M-18 | 550 | 0.36 |
| 106 | M-24 | 546 | 0.34 |

TABLE 6-continued

| Sample No. | Magenta couplers | λmax | Abs600 |
|---|---|---|---|
| 107 | M-54 | 552 | 0.35 |
| 108 | M-75 | 547 | 0.34 |
| 109 | M-77 | 548 | 0.35 |
| 110 | M-80 | 549 | 0.34 |
| 111 | M-82 | 550 | 0.33 |
| 112 | M-84 | 552 | 0.37 |
| 113 | M-88 | 554 | 0.38 |

As apparent from the Table 6, samples 102 to 113 containing the coupler of the invention show improvement in color reproduction characteristics since they have reduced absorption at 600 nm having sharp spectrum in comparison with the comparative sample 101.

EXAMPLE 2

In the following examples, the amounts of ingredients are those per square meter of the light-sensitive material, unless otherwise indicated. The amounts of a silver halide and colloidal silver are each indicated as the amount of silver.

One side (the right side) of a cellulose triacetate film support was subbed. On the other side (the backing side) of the support, layers of the following compositions were provided in sequence.

—Backing side

| | |
|---|---|
| 1st layer | |
| Alumina sol AS-100 (aluminum oxide, manufactured by Nissan Chemical Industry, Ltd.) | 0.8 g |
| 2nd layer | |
| Cellulose acetate | 100 g |
| Stearic acid | 10 mg |
| Finely divided silica (average particle size: 0.2 μm) | 50 mg |

Then, on the right side of the support that had been subbed, layers of the following compositions were provided in sequence, whereby a multilayer color photographic light-sensitive material (Sample No. 201) was obtained.

—Right side

| | |
|---|---|
| 1st layer: Anti-halation layer (HC) | |
| Black colloidal silver | 0.15 g |
| UV absorber (UV-4) | 0.20 g |
| Colored cyan coupler (CC-1) | 0.02 g |
| High-boiling solvent (DOP) | 0.20 g |
| High-boiling solvent (TCP) | 0.20 g |
| Gelatin | 1.6 g |
| 2nd layer: Intermediate layer (IL-1) | |
| Gelatin | 1.3 g |
| 3rd layer: Low-speed red-sensitive emulsion layer (R-L) | |
| Silver iodobromide emulsion (average grain size: 0.3 μm, average iodine content: 2.0 mol %) | 0.4 g |
| Silver iodobromide emulsion (average grain size: 0.4 μm, average iodine content: 8.0 mol %) | 0.3 g |

-continued

| | |
|---|---|
| Sensitizing dye (RS-2) | $3.2 \times 10^{-4}$ (mol/mol silver) |
| Sensitizing dye (RS-3) | $3.2 \times 10^{-4}$ (mol/mol silver) |
| Sensitizing dye (RS-4) | $0.2 \times 10^{-4}$ (mol/mol silver) |
| Cyan coupler (EC-3) | 0.50 g |
| Cyan coupler (EC-4) | 0.13 g |
| Colored cyan coupler (CC-1-) | 0.07 g |
| DIR compound (D-1) | 0.006 g |
| DIR compound (D-22) | 0.01 g |
| High-boiling solvent (DOP) | 0.55 g |
| Gelatin | 1.0 g |
| 4th layer: High-speed red-sensitive emulsion layer (R-H) | |
| Silver iodobromide emulsion (average grain size: 0.7 μm, average iodine content: 7.5 mol %) | 0.9 g |
| Sensitizing dye (RS-2) | $1.7 \times 10^{-4}$ (mol/mol silver) |
| Sensitizing dye (RS-3) | $1.6 \times 10^{-4}$ (mol/mol silver) |
| Sensitizing dye (RS-4) | $0.1 \times 10^{-4}$ (mol/mol silver) |
| Cyan coupler (EC-4) | 0.23 g |
| Colored cyan coupler (CC-1) | 0.03 g |
| DIR compound (D-2) | 0.02 g |
| High-boiling solvent (DOP) | 0.25 g |
| Gelatin | 1.0 g |
| 5th layer: Intermediate layer (IL-2) | |
| Gelatin | 0.8 g |
| 6th layer: Low-speed green-sensitive emulsion layer (G-L) | |
| Silver iodobromide emulsion (average grain size: 0.4 μm, average iodine content: 8.0 mol %) | 0.6 g |
| Silver iodobromide emulsion (average grain size: 0.3 μm, average iodine content: 2.0 mol %) | 0.2 g |
| Sensitizing dye (GS-2) | $6.7 \times 10^{-4}$ (mol/mol silver) |
| Sensitizing dye (GS-3) | $0.8 \times 10^{-4}$ (mol/mol silver) |
| Magenta coupler (EM-4) | 0.45 g |
| Colored magenta coupler (CM-1) | 0.10 g |
| DIR compound (D-3) | 0.02 g |
| High-boiling solvent (TCP) | 0.7 g |
| Gelatin | 1.0 g |
| 7th layer: High-speed green-sensitive emulsion layer (G-H) | |
| Silver iodobromide emulsion (average grain size: 0.7 μm; average iodine content: 7.5 mol %) | 0.9 g |
| Sensitizing dye (GS-4) | $1.1 \times 10^{-4}$ (mol/mol silver) |
| Sensitizing dye (GS-5) | $2.0 \times 10^{-4}$ (mol/mol silver) |
| Sensitizing dye (GS-6) | $0.3 \times 10^{-4}$ (mol/mol silver) |
| Magenta coupler (EM-4) | 0.35 g |
| Colored magenta coupler (CM-I) | 0.04 g |
| DIR compound (D-3) | 0.004 g |
| High-boiling solvent (TCP) | 0.35 g |
| Gelatin | 1.0 g |
| 8th layer: Yellow filter layer (YC) | |
| Yellow colloidal silver | 0.1 g |
| Additive (HS-1) | 0.07 g |
| Additive (HS-2) | 0.07 g |
| Additive (SC-1) | 0.12 g |
| High-boiling solvent (TCP) | 0.15 g |
| Gelatin | 1.0 g |
| 9th layer: Low-speed blue-sensitive emulsion layer (B-L) | |
| Silver iodobromide emulsion (average grain size: 0.3 μm; average iodine content: 2.0 mol %) | 0.25 g |
| Silver iodobromide emulsion (average grain size: 0.4 μm; average iodine content: 8.0 mol %) | 0.25 g |
| Sensitizing dye (S-9) | $5.8 \times 10^{-4}$ (mol/mol silver) |
| Yellow coupler (EY-2) | 0.6 g |
| Yellow coupler (EY-3) | 0.32 g |

-continued

| | |
|---|---|
| DIR compound (D-1) | 0.003 g |
| DIR compound (D-22) | 0.006 g |
| High-boiling solvent (TCP) | 0.18 g |
| Gelatin | 1.3 g |
| 10th layer: High-speed blue-sensitive emulsion layer (B-H) | |
| Silver iodobromide emulsion (average grain size: 0.8 μm; average iodine content: 8.5 mol %) | 0.5 g |
| Sensitizing dye (BS-4) | $3 \times 10^{-4}$ (mol/mol silver) |
| Sensitizing dye (BS-5) | $1.2 \times 10^{-4}$ (mol/mol silver) |
| Yellow coupler (EY-2) | 0.18 g |
| Yellow coupler (EY-3) | 0.10 g |
| High-boiling solvent (TCP) | 0.05 g |
| Gelatin | 1.0 g |
| 11th layer: 1st protective layer (PRO-1) | |
| Silver iodobromide emulsion (average grain size: 0.08 μm) | 0.3 g |
| UV absorber (UV-4) | 0.07 g |
| UV absorber (UV-5) | 0.10 g |
| Additive (HS-1) | 0.2 g |
| Additive (HS-2) | 0.1 g |
| High-boiling solvent (DOP) | 0.07 g |
| High-boiling solvent (DBP) | 0.07 g |
| Gelatin | 0.8 g |
| 12th layer: 2nd protective layer (PRO-2) | |
| Compound A | 0.04 g |
| Compound B | 0.004 g |
| Polymethyl methacrylate (average particle size: 3 μm) | 0.02 g |
| Methyl methacrylate/ethyl methacrylate/methacrylic acid copolymer (weight ratio: 3:3:4, average particle size: 3 μm) | 0.13 g |

The light sensitive material sample 201 further contains compounds SU-1 and SU-4, viscosity adjusting agent, hardeners HH-1 and HH-3, a stabilizer ST-1, antifoggants AF-1 and AF-2 (two kinds of AF-2 were employed; one had a weight average molecular weight of 10,000 and the other with a weight average molecular weight of 1,100,000), dyes AI-1, AI-2 and DI-1 (content: 9.4 g/m$^2$).

The silver iodobromide emulsion contained in the 10th layer was prepared by the double-jet method as described below.

Silver iodobromide emulsion was prepared by double jet method to grow seed grains of monodispersed silver iodobromide grains having an average grain size of 0.33 μm and an average silver iodide content of 2 mol %.

To the solution G-1, of which the temperature, pAg and pH had been kept at 70° C., 7.8 and 7.0, respectively, a 0.34 mol-equivalent amount of seed grains were added with stirring.

<Preparation of internal high iodide phase-core phase>

Then, solutions H-1 and S-1 were added over a period of 86 minutes at an accelerated flow rate so that the flow rate immediately before the start of addition would be 3.6 times as high as that immediately after the start of addition. The ratio of the flow rate of solution H-1 to that of S-1 was kept at 1:1.

<Preparation of external low iodide phase-shell phase>

Subsequently, while keeping pAg and pH at 10.1 and 6.0, respectively, solutions H-2 and S-2 were added over a period of 65 minutes at an accelerated flow rate so that the flow rate immediately before the start of addition would be 5.2 times as high as that immediately after the start of addition. The ratio of the flow rate of solution H-1 to that of S-1 was kept at 1:1.

During the formation of the silver halide grains, pAg and pH were controlled with an aqueous potassium bromide solution and a 56% aqueous acetic acid solution. The so-formed grains were washed with water by the conventional flocculating method. Gelatin was then added to make the grains redispersed, and pH and pAg were controlled at 40° C. to 5.8 and 8.06, respectively.

The emulsion consisted of monodispersed, octahedral silver iodobromide grains with an average grain size of 0.80 μm, a variation coefficient of 12.4% and a silver iodide content of 8.5 mol %.

| <G-1> | |
|---|---|
| Ossein gelatin | 100.0 g |
| Compound-I (10 wt % methanol solution) | 25.0 ml |
| 28% aqueous ammonium solution | 440.0 ml |
| 56% aqueous acetic acid solution | 660.0 ml |
| Water was added to make the total quantity | 5,000.0 ml. |
| <H-1> | |
| Ossein gelatin | 82.4 g |
| Potassium bromide | 151.6 g |
| Potassium iodide | 90.6 g |
| Water was added to make the total quantity | 1030.5 ml. |
| <S-1> | |
| Silver nitrate | 309.2 g |

-continued

| | |
|---|---|
| 28% aqueous ammonia solution | Equivalent |
| Water was added to make the total quantity | 1030.5 ml. |
| <H-2> | |
| Ossein gelatin | 302.1 g |
| Potassium bromide | 770.0 g |
| Potassium iodide | 33.2 g |
| Water was added to make the total quantity of | 3776.8 ml. |
| <S-2> | |
| Silver nitrate | 1133.0 g |
| 28% aqueous ammonia solution | Equivalent amount |
| Water was added to make the total quantity | 3776.8 ml. |

Emulsions differing in average grain size and silver iodide content were prepared in substantially the same manner as mentioned above, except that the average size of seed grains, temperature, pAg, pH, flow rate, addition time and halide composition were varied.

Each of the resulting emulsions was a core/shell type emulsion consisting of monodispersed grains with a variation coefficient of 20% or less. Each emulsion was chemically ripen to an optimum level in the presence of chloroauric acid and ammonium thiocyanate, and then spectrally sensitized with a sensitizing dye, 4-hydroxy-6-methyl-1,3,3*a*,7-tetrazaindene and 1-phenyl-5-mercaptotetrazole.

Chemical structures of compounds used in each layer are shown.

EC-3

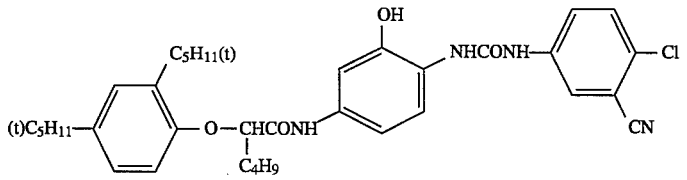

EC-4

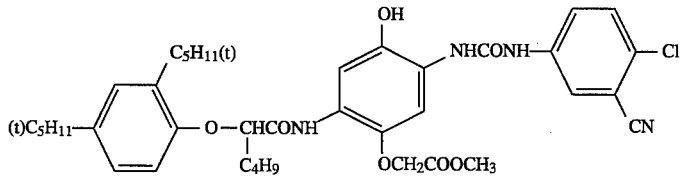

EM-4

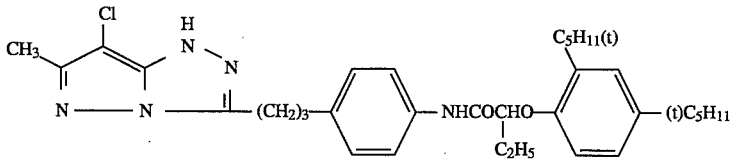

EY-2

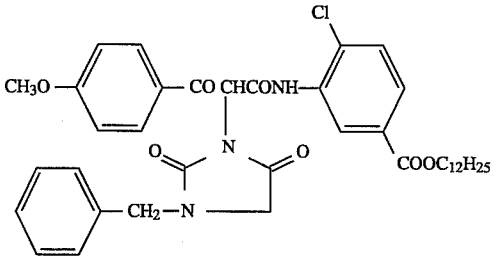

-continued
EY-3
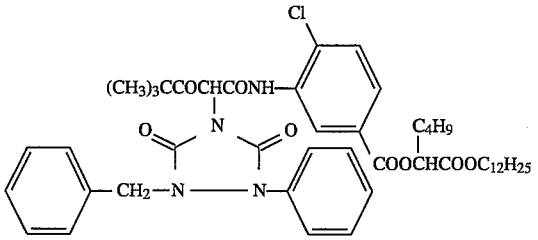
CC-1
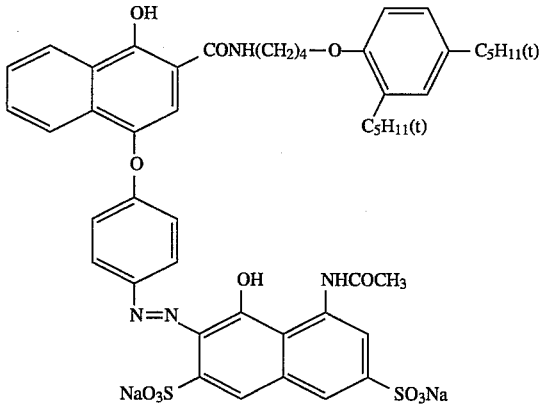
CM-1
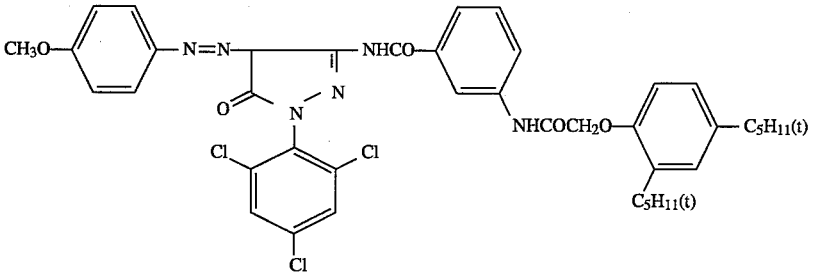
D-1
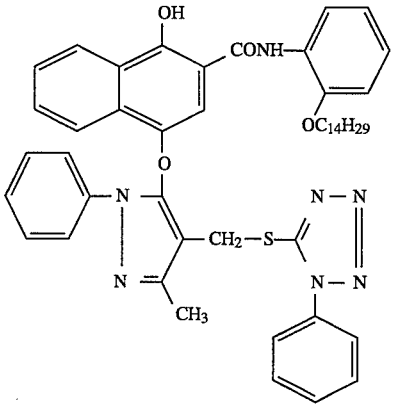
D-2
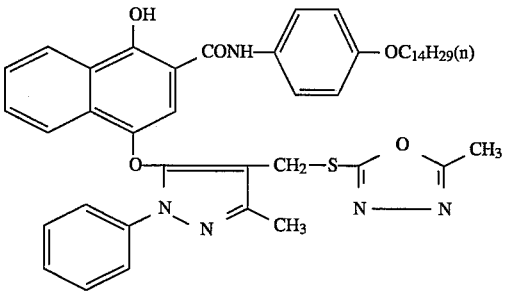

-continued
D-3
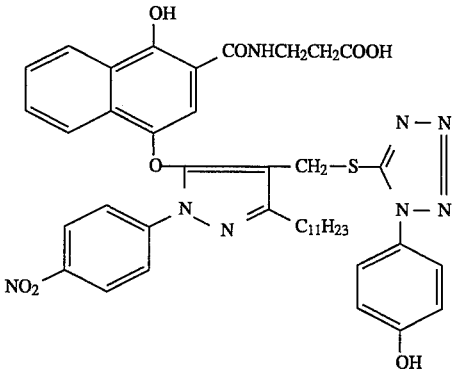
UV-4
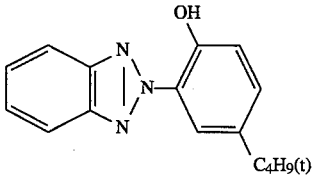
UV-5
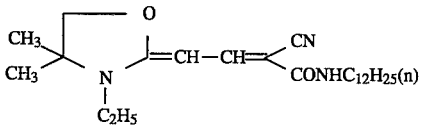
RS-2
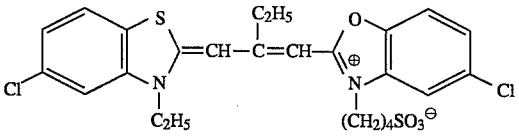
RS-3
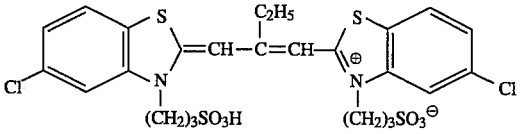
RS-4
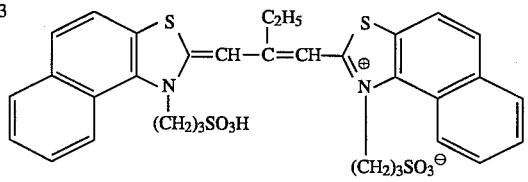
GS-2
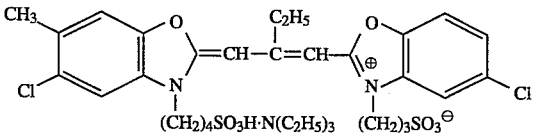
GS-3
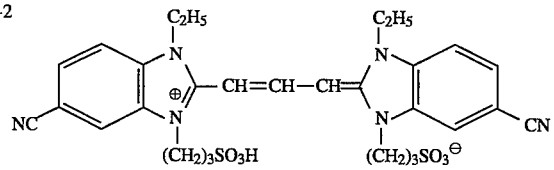
RS-4
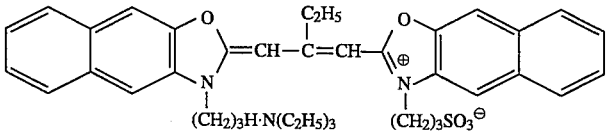
GS-5
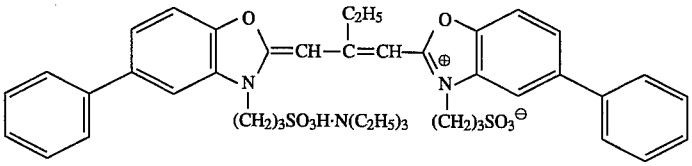
GS-6
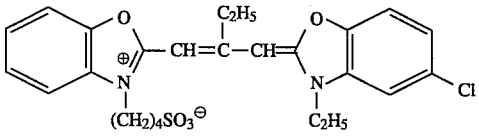
BS-3
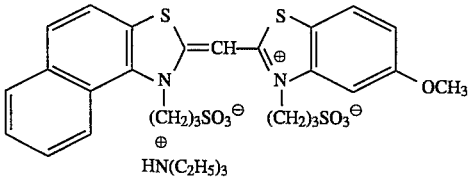
BS-4
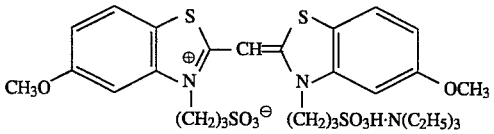

-continued
BS-5
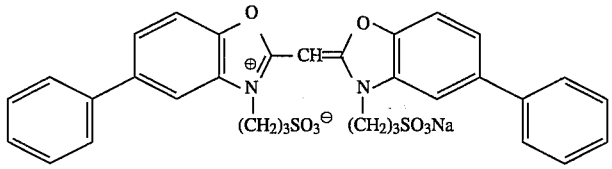
HS-1
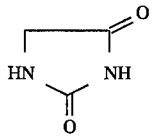
HS-2
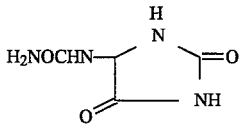
SC-1
a mixture of
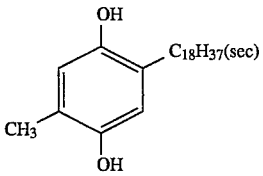
and
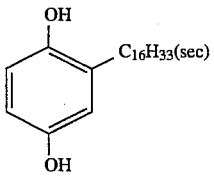
(2:3)
DOP: Dioctyl phthalate
DBP: Dibutyl phthalate
TCP: Tricredyl phthalate
H-2
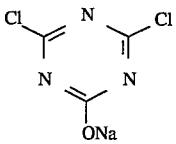
H-3
$(CH_2{=}CHSO_2CH_2)_4CH$
SU-1
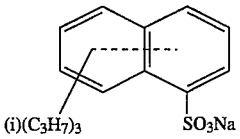
SU-4
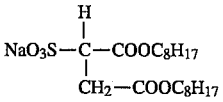
AI-1
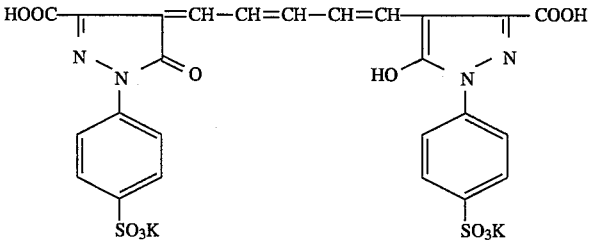
AI-2
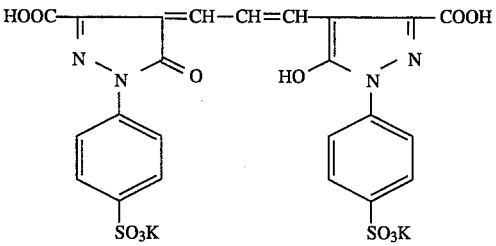
ST-1
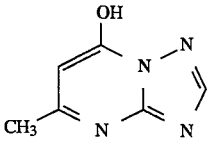

-continued

AF-1

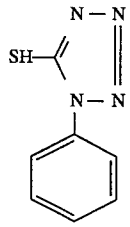

AF-2

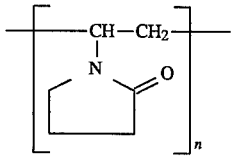

Compound A

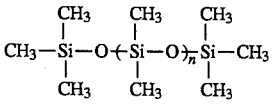

Mw = 3,000 (weight-average molecular weight)

Compound B

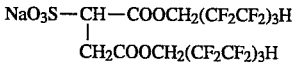

DI-1

(Mixture of the following 3 components)

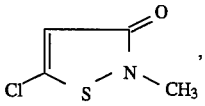

(Component A)

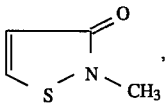

(Component B)

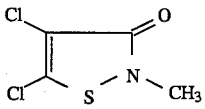

(Component C)

Component A:Component B:Component C = 50:46:4 (mole ratio)

Compound-I

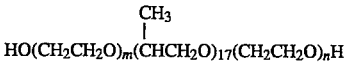

(average molecular weight ≈ 1,300)

Sample Nos. 202 to 219 were prepared in substantially the same manner as in the preparation of Sample No. 101, except that the magenta couplers in the 6th and 7th layers were replaced with those shown in Table 8.

Each sample was exposed to white light through a step wedge, and processed according to the following procedures (Developing Process I).

Processing steps

| Procedure | Time | Temperature | Repl. Amount* |
|---|---|---|---|
| Color developing | 3'15" | 38 ± 0.3° C. | 780 ml |
| Bleaching | 45" | 38 ± 2.0° C. | 150 ml |
| Fixing | 1'30" | 38 ± 2.0° C. | 830 ml |
| Stabilizing | 60" | 38 ± 5.0° C. | 830 ml |
| Drying | 1' | 55 ± 5.0° C. | — |

*The amount of a replenisher is that per square meter of a light-sensitive material.

The compositions of the processing liquids were as follows.

<Color Developer>

| | |
|---|---|
| Water | 800 ml |
| Potassium carbonate | 30 g |
| Sodium bicarbonate | 2.5 g |
| Potassium sulfite | 3.0 g |
| Sodium bromide | 1.3 g |
| Potassium iodide | 1.2 mg |
| Hydroxylamine sulfate | 2.5 g |
| Sodium chloride | 0.6 g |
| 4-amino-3-methyl-N-ethyl-N-(β-hydroxyethyl) aniline sulfate | 4.5 g |
| Diethylenetriaminepentacetic acid | 3.0 g |
| Potassium hydroxide | 1.2 g |

Water was added to make the total quantity 11, and pH was controlled to 10.06 with potassium hydroxide or 20% sulfuric acid.

<Color Developer Replenisher>

| | |
|---|---|
| Water | 800 ml |
| Potassium carbonate | 35 g |
| Sodium bicarbonate | 3 g |
| Potassium sulfite | 5 g |
| Sodium bromide | 0.4 g |
| Hydroxylamine sulfate | 3.1 g |
| 4-amino-3-methyl-N-ethyl-N-(β-hydroxyethyl) aniline sulfate | 6.3 g |
| Potassium hydroxide | 2 g |
| Diethylenetriaminepentacetic acid | 3.0 g |

Water was added to make the total quantity 11, and pH was controlled to 10.18 with potassium hydroxide or 20% sulfuric acid.

<Bleacher>

| | |
|---|---|
| Water | 700 ml |
| Ferric ammonium 1,3-diaminopropanetetracetate (III) | 125 g |
| Ethylenediaminetetracetic acid | 2 g |

-continued

| | |
|---|---|
| Sodium nitrate | 40 g |
| Ammonium bromide | 150 g |
| Glacial acetic acid | 40 g |

Water was added to make the total quantity 11, and pH was controlled to 4.4 with aqueous ammonia or glacial acetic acid.

<Bleacher Replenisher>

| | |
|---|---|
| Water | 700 ml |
| Ferric ammonium 1,3-diaminopropanetetracetate (III) | 175 g |
| Ethylenediaminetetracetic acid | 2 g |
| Silver nitrate | 50 g |
| Ammonium bromide | 200 g |
| Glacial acetic acid | 56 g |

After adjusting pH to 4.0 with aqueous ammonia or glacial acetic acid, water was added to make the total quantity 11.

<Fixer>

| | |
|---|---|
| Water | 800 ml |
| Ammonium thiocyanate | 120 g |
| Ammonium thiosulfate | 150 g |
| Sodium sulfite | 15 g |
| Ethylenediaminetetracetic acid | 2 g |

After adjusting pH to 6.2 with aqueous ammonia or glacial acetic acid, water was added to make the total quantity 11.

<Fixer Replenisher>

| | |
|---|---|
| Water | 800 ml |
| Ammonium thiocyanate | 150 g |
| Ammonium thiosulfate | 180 g |
| Sodium sulfite | 20 g |
| Ethylenediaminetetracetic acid | 2 g |

After adjusting pH to 6.5 with aqueous ammonia or glacial acetic acid, water was added to make the total quantity 11.

<Stabilizer and Stabilizer Replenisher>

| | |
|---|---|
| Water | 900 ml |
| Compound | 2.0 g |

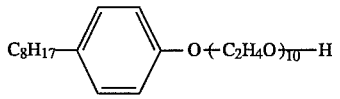

| | |
|---|---|
| [Dimethylol urea | 0.5 g |
| Hexamethylene tetramine | 0.2 g |
| 1,2-benzisothiazoline-3-on | 0.1 g |

-continued

| | |
|---|---|
| Siloxane (L-77, manufactured by UCC) | 0.1 g |
| Aqueous ammonia | 0.5 ml |

Water was added to make the total quantity 1, and pH was adjusted to 8.5 with 50% sulfuric acid or aqueous ammonia.

Sample Nos. 201 to 219 were exposed to white light through a step wedge (specifically designed for sensitometry), and processed in the same way as mentioned above, except that the pH of the developer was varied to 9.90 (Developing Process II).

For each of the processed samples, maximum density of magenta dye was measured with green light by means of optical densitometer PDA-6 (manufactured by Konica Corporation). Maximum color density, relative sensitivity and pH influence are shown in Table 8. The evaluation for pH influence is given by a ratio of maximum densty obtained by Developing process I to maximum densty obtained by Developing process II, that is, $$\frac{D\text{Max by Developing Processing II}}{D\text{Max by Developing Processing I}} \times 100(\%)$$

TABLE 8

| Sample | Magenta Coupler | Maximum Density | Relative Sensitivity | pH influence |
|---|---|---|---|---|
| 201 | EM-4 | 2.38 | 100 | 63 |
| 202 | M-1 | 2.56 | 125 | 84 |
| 203 | M-2 | 2.64 | 131 | 82 |
| 204 | M-3 | 2.47 | 129 | 85 |
| 205 | M-4 | 2.49 | 126 | 86 |
| 206 | M-5 | 2.42 | 124 | 85 |
| 207 | M-6 | 2.50 | 130 | 87 |
| 208 | M-7 | 2.41 | 125 | 87 |
| 209 | M-9 | 2.43 | 124 | 84 |
| 210 | M-10 | 2.44 | 126 | 83 |
| 211 | M-55 | 2.60 | 130 | 82 |
| 212 | M-56 | 2.54 | 126 | 87 |
| 213 | M-57 | 2.55 | 128 | 84 |
| 214 | M-58 | 2.63 | 132 | 81 |
| 215 | M-59 | 2.47 | 125 | 87 |
| 216 | M-64 | 2.44 | 119 | 88 |
| 217 | M-71 | 2.42 | 109 | 85 |
| 218 | M-72 | 2.45 | 114 | 84 |
| 219 | M-73 | 2.44 | 121 | 84 |

The Relative Sensitivity is a value of reciprocal number of exposure necessary to give a density of fog density plus 0.10, and shown relatively taking the sample 201 as 100. The values of relative sensitivity and maximum density are measured for the samples processed by Developing Processing I.

As is evident from the results, the samples No. 202 to 219 containing the coupler of the invention are remarkably improved in maximum density, sensitivity and pH influence in comparison with Sample 201 containing a conventional coupler EM-4.

We claim:

1. A silver halide color photographic light sensitive material comprising a support and a light sensitive silver halide emulsion layer containing a magenta coupler wherein the magenta coupler is represented by a formula I-a,

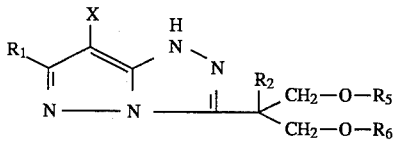
I-a
wherein $R_1$ is a hydrogen atom or an alkyl group, $R_2$ represents a hydrogen atom or an alkyl group, $R_5$ and $R_6$ each represents a hydrogen atom or a sulfonyl, phosphonyl or acyl group, and X is a chlorine atom or a group represented by
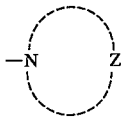
wherein Z is atoms selected from a carbon oxygen, nitrogen, or sulfur atom to complete a 5- or 6 membered cycle with the nitrogen atom.
* * * * *